US012359657B2

(12) United States Patent
Miguel et al.

(10) Patent No.: US 12,359,657 B2
(45) Date of Patent: Jul. 15, 2025

(54) SYSTEM FOR TRANSPORTING LUBRICATING OIL IN A COMPRESSOR

(71) Applicant: NIDEC GLOBAL APPLIANCE BRASIL LTDA., Joinville (BR)

(72) Inventors: Edson Correa Miguel, Joinville (BR); Andrey Hense, Joinville (BR); Filipe Longarete, Joinville (BR); Mauricio Pereira Tada, Joinville (BR); Emilio Rodrigues Hulse, Joinville (BR)

(73) Assignee: NIDEC GLOBAL APPLIANCE BRASIL LTDA., Joinville (BR)

( * ) Notice: Subject to any disclaimer, the term of this patent is extended or adjusted under 35 U.S.C. 154(b) by 0 days.

(21) Appl. No.: 17/792,911

(22) PCT Filed: Jan. 18, 2021

(86) PCT No.: PCT/BR2021/050019
§ 371 (c)(1),
(2) Date: Jul. 14, 2022

(87) PCT Pub. No.: WO2021/142525
PCT Pub. Date: Jul. 22, 2021

(65) Prior Publication Data

US 2023/0065792 A1 Mar. 2, 2023

(30) Foreign Application Priority Data

Jan. 17, 2020 (BR) ..... 10 2020 001095 6
Jan. 15, 2021 (BR) ..... 10 2021 000804 0

(51) Int. Cl.
*F04B 39/02* (2006.01)

(52) U.S. Cl.
CPC ..... *F04B 39/0284* (2013.01); *F04B 39/02* (2013.01)

(58) Field of Classification Search
CPC ..... F04B 39/0284; F04B 39/02
See application file for complete search history.

(56) References Cited

U.S. PATENT DOCUMENTS 3,276,677 A 10/1966 Trask
3,560,116 A * 2/1971 Valbjorn et al. ..... H02K 5/12 417/372

(Continued)

FOREIGN PATENT DOCUMENTS

KR 547434 B1 1/2006
SU 1435812 A1 * 11/1988
WO WO-9322557 A1 * 11/1993 ..... F04B 39/0261

OTHER PUBLICATIONS

English Translation of SU-1435812-A1 (Year: 1988).*

(Continued)

*Primary Examiner* — Connor J Tremarche
(74) *Attorney, Agent, or Firm* — FOLEY & LARDNER LLP

(57) ABSTRACT

The present invention relates to a lubricating oil transport system in a compressor, in which:

the rotating shaft (3) has at least one concavity (35) that extends over part of the rotating surface (33) in contact with the internal surface (11) of the rotor (1) and at least one restrictor hole (34) that communicates with the internal region of the rotating shaft (3) and with the concavity (35);

the rotor (1) comprises a circumferential channel (12) and at least one radial channel (13) extending through the inner wall (11) of the rotor (1);

the radial channel (13) is arranged around the circumferential channel (12);

said circumferential channel (12) and the radial channel (13) communicating with the concavity (35);

(Continued)

the circumferential channel (12), the radial channel (13) and the concavity (35) transport oil for cooling the upper part of the rotor (1) and the stator (2).

5 Claims, 29 Drawing Sheets

(56) References Cited

U.S. PATENT DOCUMENTS

| | | | | |
|---|---|---|---|---|
| 3,848,702 | A * | 11/1974 | Bergman | F16N 7/366 418/94 |
| 4,400,142 | A | 8/1983 | Ohlson, Jr. | |
| 7,100,743 | B2 * | 9/2006 | Park | F04B 39/0246 184/6.16 |
| 9,217,434 | B2 | 12/2015 | Han et al. | |
| 9,617,985 | B2 | 4/2017 | Park | |
| 2004/0151604 | A1 * | 8/2004 | Ishida | F04B 39/0253 417/372 |
| 2005/0115771 | A1 * | 6/2005 | Shin | F04B 39/023 184/6.16 |
| 2013/0309119 | A1 * | 11/2013 | Kim | F04B 39/0261 418/55.6 |

OTHER PUBLICATIONS

International Search Report & Written Opinion of the International Searching Authority issued in PCT Application No. PCT/BR2021/050019, mailed Jun. 17, 2021.

* cited by examiner

SYSTEM FOR TRANSPORTING LUBRICATING OIL IN A COMPRESSOR

CROSS REFERENCE TO RELATED APPLICATIONS

This application is a national stage entry of PCT Application No. PCT/BR2021/050019, filed on Jan. 18, 2021, which claims priority to Brazilian Application No. 10 2020 001095 6, filed on Jan. 17, 2020, and Brazilian Application No. 10 2021 000804 0, filed on Jan. 15, 2021, the contents of all of which are incorporated herein by reference in their entireties.

TECHNICAL FIELD

The present invention relates to a compressor lubricating oil transport system that uses configurations applied to the rotating shaft and to the rotor of the electric motor to provide oil transportation for the purpose of lubricating the bearings of said rotating shaft and for purposes of cooling the upper region of the coils of said electric motor.

BACKGROUND OF THE INVENTION

As is known to those skilled in the art, hermetic compressors (usually reciprocating), provide for the use of lubricating oil to reduce friction and wear between moving components and, in particular, moving components that integrate the functional compression unit of the hermetic compressor, such as, for example, the eccentric shaft, the central rotating shaft, support bearings, among others. Lubricating oil is usually stored in a reservoir in the lower inner portion of the airtight housing.

In this sense, it is mandatory that the lubricating oil, stored in the lower portion of the hermetic compressor housing, be transported to the moving elements that integrate the compression functional units (moving parts) of the hermetic compressor. Thus, it is common to take advantage of the movement of the compressor's own rotating shaft to transport or pump this lubricating oil to the regions where the oil is needed.

As illustrated in FIG. 1, said compressor comprises a housing 8, said housing being commonly hermetic, and an electric motor formed by a rotor 1 and stator 2. In addition, a rotating shaft 3 is operated in association with the rotor 1 of the electric motor; the rotor 1 comprising at least one internal wall 11 that faces the rotating shaft 3. It is worth noting that it is common to have an interference assembly between the rotor 1 and the rotating shaft 3 in order to be able to transmit the torque generated by the electric motor for the compression mechanism.

Additionally, a compressor block 4 is provided in order to partially accommodate the rotating shaft 3. An oil pump 6 is coupled to the shaft-rotor set and partially immersed in an oil reservoir 7 disposed in the lower portion of the housing 8 of the compressor.

For proper operation of the mechanical systems of the compressor, the rotating shaft 3 is provided with radial bearings, such as, for example, the radial bearings 5*a* and 5*b*, arranged in different positions in relation to said rotating shaft 3. The radial bearings 5*a* and 5*b* must receive lubrication from the lubricating oil of the oil reservoir 7.

As can be seen in more detail in FIG. 2 for the purpose of understanding the lubrication system commonly used in hermetic compressors, it is possible to divide the rotating shaft 3 into a lower region 31, an upper region 32 and a rotating region 33. Said lower region 31 has the function of housing by interference the oil pump 6 disposed in the oil reservoir 7; said rotating region 33, bounded by the housing of the shaft in the block 4 and by the portion interfering with the rotor 1, contains a duct 36, an opening 37 and an external helical channel 38 which together feed with lubricating oil the radial bearings 5*a* and 5*b* located, respectively, at the end of the rotating region 33 and in the upper region 32 of the rotating shaft 3.

It is common in the art that the lubricating oil transport is performed by a lubricating oil pump, which acts in cooperation with the rotating shaft of the compressor that transports the oil with the aid of mechanical drag. In order to allow lubricating oil to enter the rotating shaft 3, the oil pump 6 is provided with a hole 39 in the lower region and, by centrifugal force, raises that oil until it finds the duct 36, which further accelerates the fluid. The helical channel 38, located outside the rotating region 33, has a mechanical pumping function, by dragging against the housing of the shaft in the compressor block 4.

A secondary function performed by the lubricating oil is to remove heat from the electromechanical assembly and assist in its transmission to the environment outside the compressor through the hermetic housing. In most compressors, this oil flow is a result of the excess pumping of lubricating oil to the bearings which naturally returns to the bottom of the hermetic housing. However, it is also possible to direct part of the oil flow to specific points of the motor, promoting additional cooling that reduces the temperature of these components and, therefore, increases the life of the compressor as a whole.

For example, the document U.S. Pat. No. 9,217,434, entitled "COMPRESSOR HAVING DRIVE SHAFT WITH FLUID PASSAGES", published on Oct. 18, 2012, presents a compressor that comprises a rotating shaft that presents several oil transport channels located internally to said shaft. The channels presented in this document make it possible to transport lubricating oil from an oil reservoir located at the bottom of the compressor housing to the top of the electric motor, with this flow being specifically applied to the cooling of the motor coils. It is noted that the same oil flow that runs through these internal channels is applied in the lubrication of bearings that support moving parts of the compressor.

However, it is observed that the use of the oil flow that is carried through the channels internal to the rotating shaft, both for cooling purposes and for lubrication purposes, can cause failures in the oil supply, which would lead to problems in the lubrication of the bearings. In addition, there may be a reduction in the pumping pressure, since the flow of oil in the internal channels is diffuse, being divided along the rotating shaft.

In addition, document KR547434, entitled "A COOLING STRUCTURE OF END-COIL FOR HERMETIC COMPRESSOR", published on Oct. 24, 2005, describes a compressor equipped with a rotor, an axis and a passage channel, this passage carrying lubricating oil from a pumping element. A concavity element is provided and comprises a series of radial openings that aim to distribute the flow of lubricating oil in the lower part of the stator. The purpose of the lubricating oil flow is to reduce the temperature/heat removal from the coils.

However, the solution proposed in this document does not allow to cool the upper part of the coils, which would continue without an additional oil flow. The durability of electrical insulators would continue to be determined by the hottest point of the coils at the top.

Additionally, the document U.S. Pat. No. 9,617,985, entitled "HERMETIC RECIPROCATING COMPRESSOR", published on Oct. 31, 2013, describes a compressor that comprises a shaft, said shaft being provided with a helical channel that allows the lubricating oil to rise up to the top of the shaft. Additionally, an orifice is provided in the upper part of the shaft, said orifice being in communication with an eccentric part. The fundamental feature of this document is the fact that the external helical channel communicates directly with the oil pump mounted on the bottom of the shaft with the sole purpose of providing lubricating oil for the hermetic compressor bearings.

However, this document does not describe a system in which the external channels in the shaft cooperate with the channel system in the rotor to ensure an oil flow to the bearings without the amount of oil supplied by the pumping system to the bearings being impaired.

SUMMARY

An objective of the present invention is to provide a lubricating oil transport system that avoids the problems of the state of the art.

Such objective is achieved by means of system for transporting lubricating oil in a compressor, comprising:

- a housing;
- an electric motor comprising a rotor and a stator,
- the rotor comprising at least one inner wall;
- an oil pump and an oil reservoir arranged inside the housing;
- a rotary shaft as an integral part of the electric motor;
- a compressor block capable of housing, at least partially, the rotary shaft;
- the rotary shaft supported by at least one radial bearing;
- the rotary axis comprising a lower region, an upper region and a rotating surface;
- wherein the rotating shaft has at least one concavity that extends over part of the rotating surface in contact with the internal surface of the rotor and at least one restrictor hole which communicates with the internal region of the rotating shaft and with the concavity;
- the rotor comprises a circumferential channel and at least one radial channel extending through the inner wall of the rotor;
- the radial channel is arranged around the circumferential channel;
- said circumferential channel) and the radial channel communicating with the concavity;
- the circumferential channel, the radial channel and the concavity transport oil for cooling the upper part of the rotor and the stator.

Conveniently, the system according to the present invention consists of the fact that the concavity has a helicoid shape.

Additionally, the system according to the present invention consists of the fact that the circumferential channel has an external diameter smaller than the external diameter of the rotating shaft housing in the compressor block.

In addition, the system according to the present invention consists of the fact that the radial channel outlet is inscribed in a circle with a diameter larger than the outer diameter of the rotating shaft housing in the compressor block.

Furthermore, the system according to the present invention consists of the fact that the concavity has an annular shape and the rotor does not need the circumferential channel, communicating the radial channel directly with said annular-shaped concavity.

Additionally, the system according to the present invention consists of the fact that the rotating shaft does not need the concavity, directly communicating the restricting hole to the circumferential channel.

The present invention also provides a system for transporting lubricating oil in a compressor, comprising:

- a housing;
- an electric motor comprising a rotor and a stator,
- the rotor comprising at least one inner wall;
- an oil pump and an oil reservoir arranged inside the housing;
- a rotating shaft as an integral part of the electric motor;
- a compressor block capable of housing, at least partially, the rotating shaft;
- the rotating shaft supported by at least one radial bearing;
- the rotating shaft comprising a lower region, an upper region and a rotating surface;
- wherein the rotor has at least one radial channel arranged around a circumferential channel;
- wherein the circumferential channel extends over at least part of the inner wall of the rotor;
- wherein the circumferential channel is located at an intermediate level between the upper part of the oil pump and the lower region of the rotating shaft; and
- wherein the circumferential channel and the radial channel carry oil for cooling the upper part of the rotor and the stator.

Conveniently, the system according to the present invention consists of the fact that the radial channel outlet is inscribed in a circle with a diameter larger than the outer diameter of the rotating shaft housing in the compressor block.

Additionally, the system according to the present invention consists of the fact that there is a partial juxtaposition between the entrance of the radial channel and the outer diameter of the circumferential channel.

Thus, the main objective of the present invention is to reveal a lubricating oil transport system in a hermetic compressor that uses configurations applied to the rotating shaft and applied to the rotor of the electric motor.

Furthermore, the present invention also aims to reveal a lubricating oil transport system in a hermetic compressor that allows the provision of oil transport for the purpose of lubricating support bearings and for the purpose of cooling the upper region of the electric motor coils.

Finally, it is the objective of the present invention to provide a lubricating oil transport system in a hermetic compressor that does not present lubricating oil flow failures or lubricating oil pumping pressure drop.

BRIEF DESCRIPTION OF THE FIGURES

The preferred embodiments of the present invention are described in detail based on the Figures listed below.

DETAILED DESCRIPTION OF THE INVENTION

Figure 1:
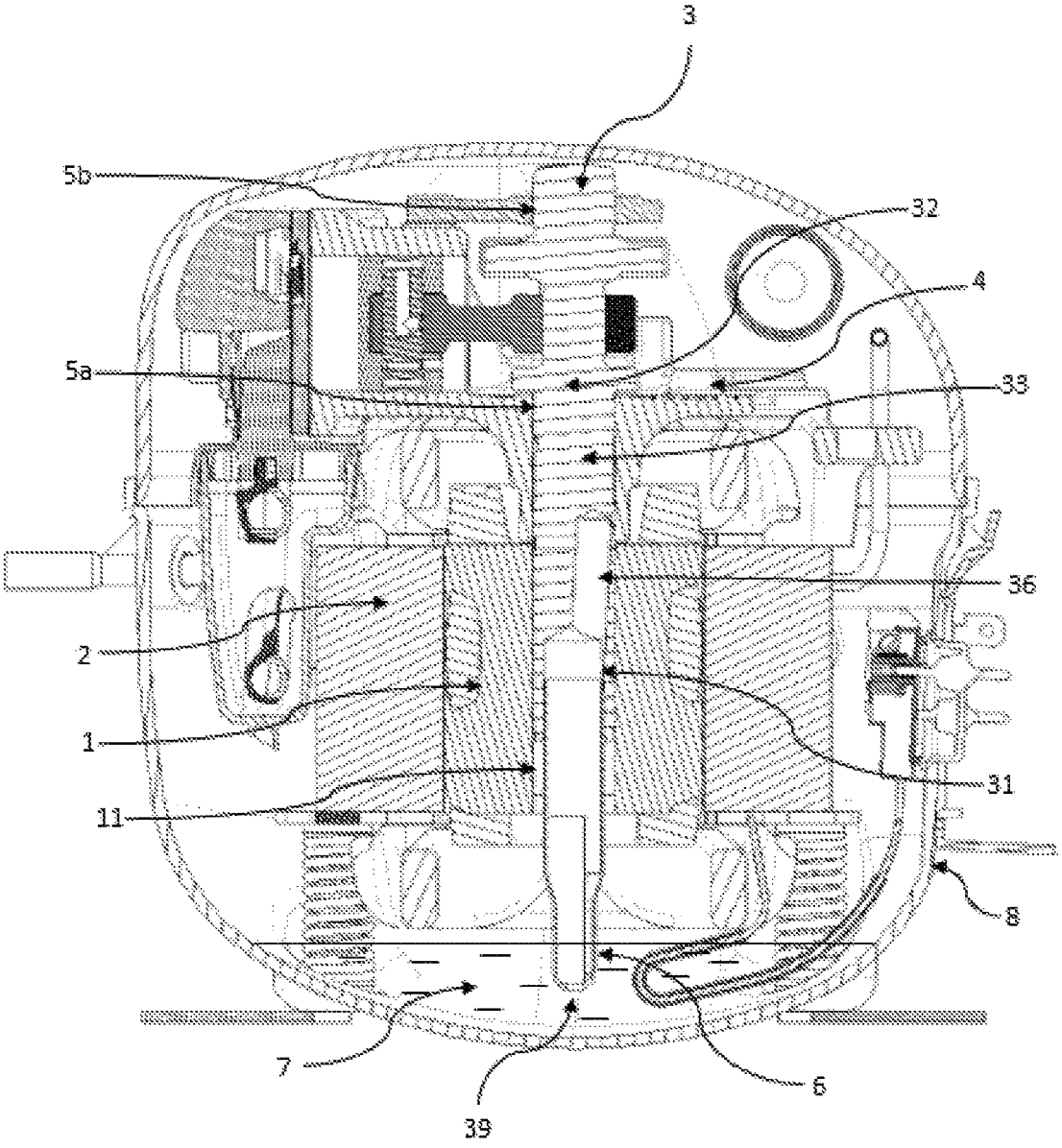
FIG. 1 illustrates a sectional view of the compressor illustrating the state of the art, with the conventional oil pumping system exclusively for the compressor bearings.
Figure 2:
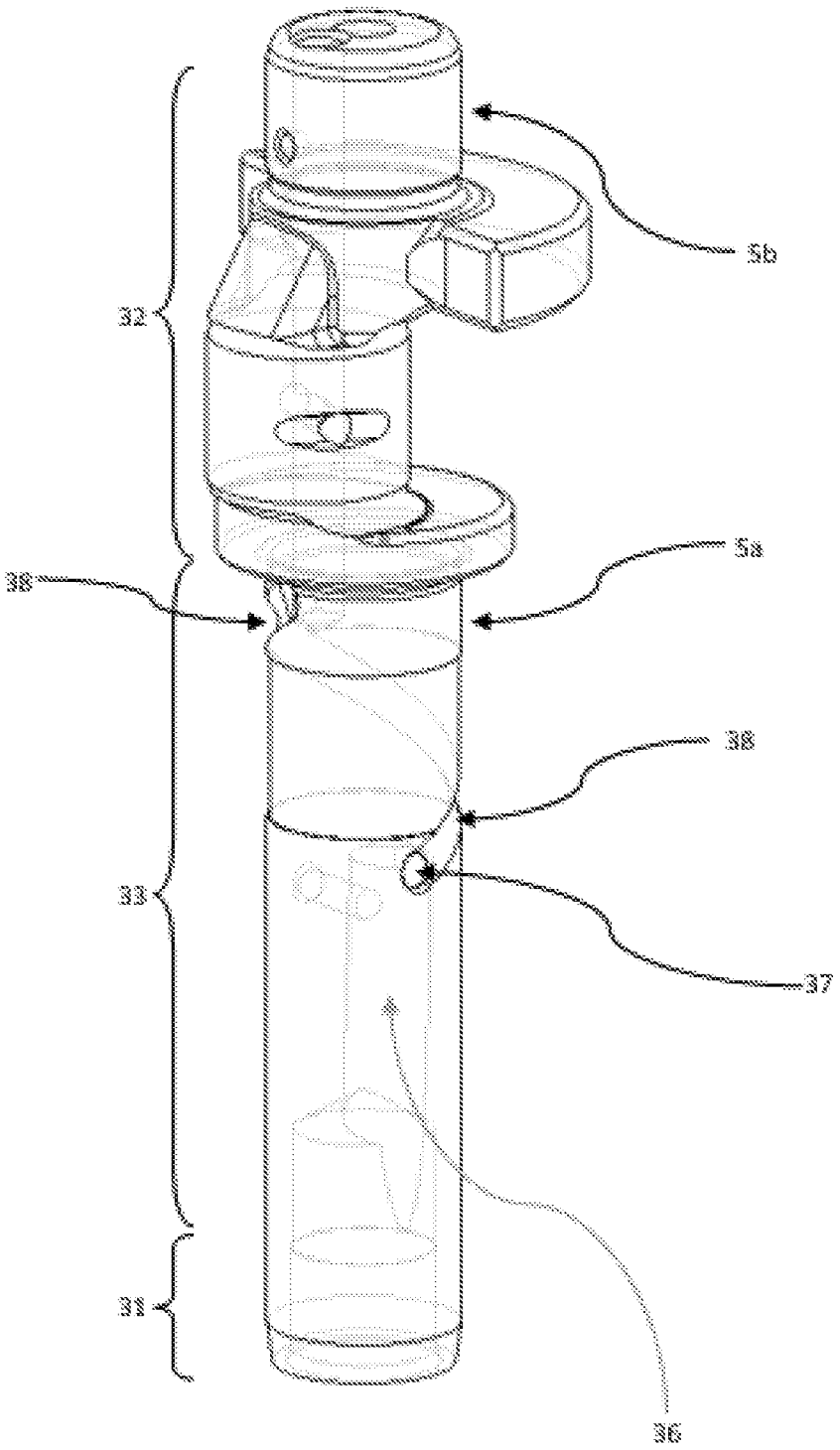
FIG. 2 illustrates a perspective view of a rotating shaft of the state of the art, with the oil pumping system exclusively for the compressor bearings.
Figure 3:
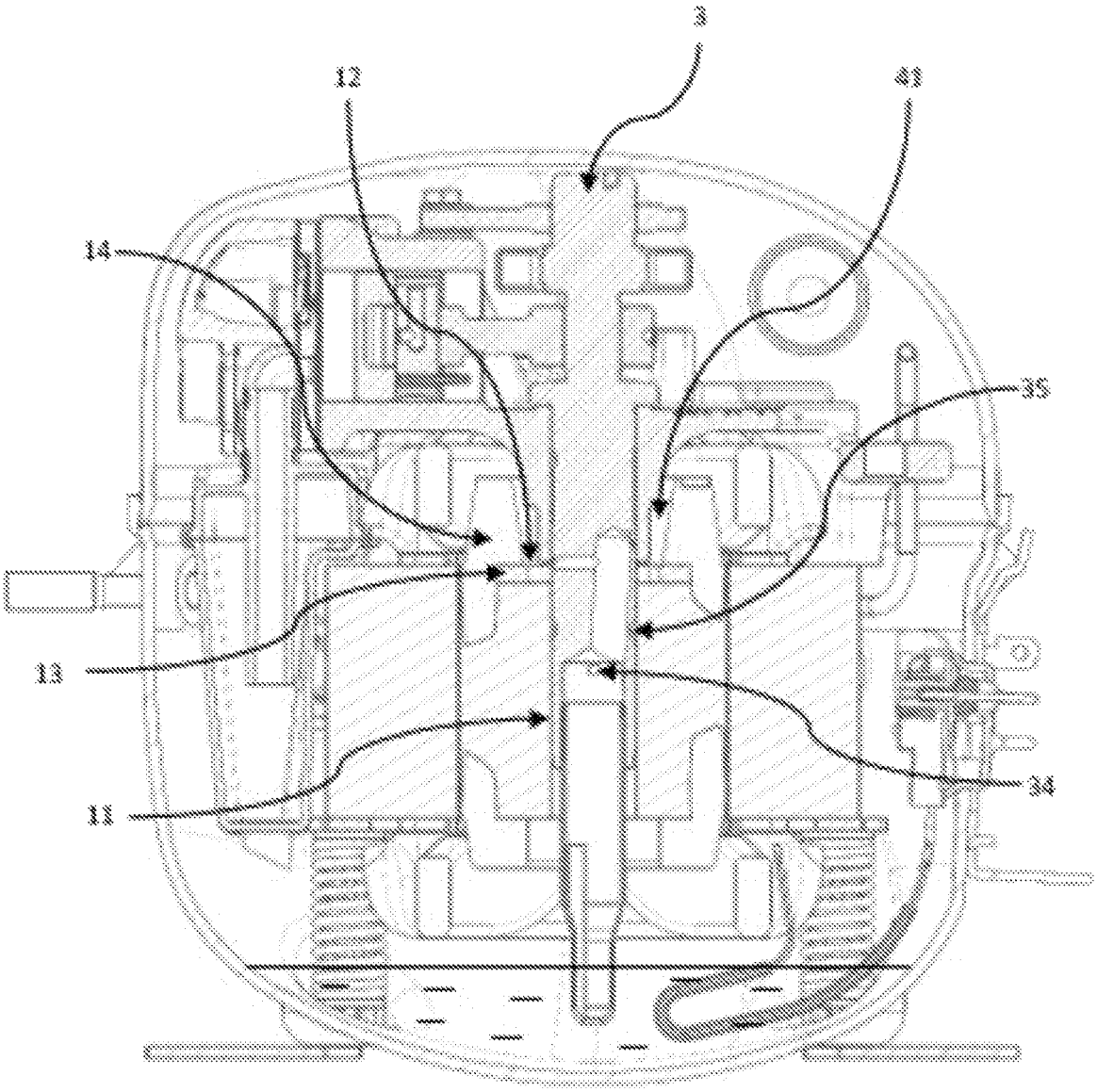
FIG. 3 illustrates a sectional view of the first embodiment of the compressor showing the lubricating oil transport system including the arrangement for cooling the engine coils by the oil jet.

In accordance with the general objectives of the present invention, a lubricating oil transport system is provided in a hermetic compressor for cooling the upper coils of the electric motor in addition to the normal lubricating oil transport system for the bearings and moving parts, as shown in FIG. 3.

Figure 4:
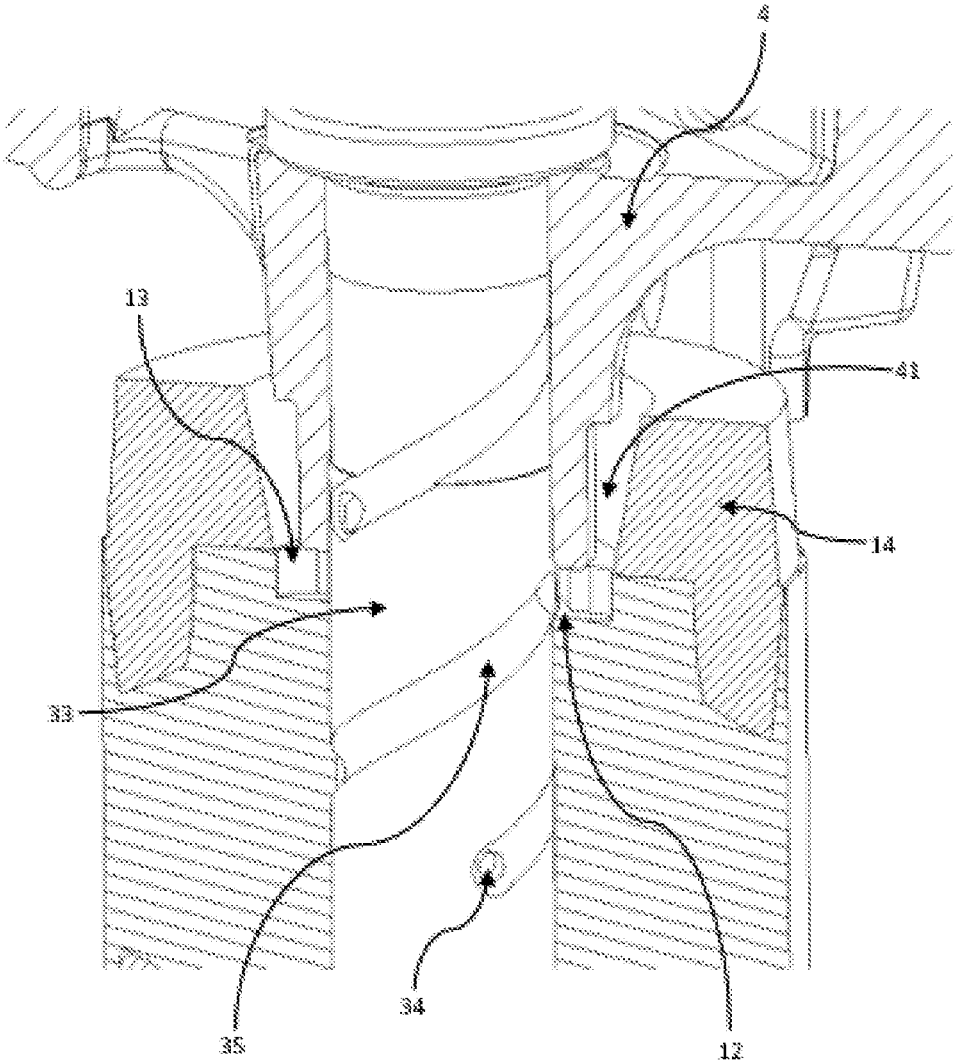
FIG. 4 illustrates a perspective view of the first embodiment of the rotor-rotating shaft set with the rotor in section to show the helical concavities external to the shaft and how they cooperate with the channels placed on the top of the rotor according to present invention.

According to FIG. 4, the lubricating oil transport system of the present invention is defined by the fact that the rotating shaft 3 comprises at least one concavity 35, said concavity 35 extends over part of the rotating surface 33, and a restrictor hole 34, said hole 34 communicates the concavity 35 with the internal region of the rotating shaft 3. The concavity 35 and the restrictor hole 34 are responsible for diverting a portion of lubricating oil, coming from the oil pump 6, from the internal region of the rotating shaft 3.

Said concavity 35, in general, defines a type of recess formed in the rotating surface 33 of the rotating shaft 3, such concavity 35 being partially closed by the inner wall 11 of the rotor 1. Thus, for the lubricating oil be transported, the rotating surface 33 interacts with the inner wall 11 of the rotor 1, forming a type of pumping mechanism that operates by centrifugal force, depending on the operation of the compressor.

Figure 5:
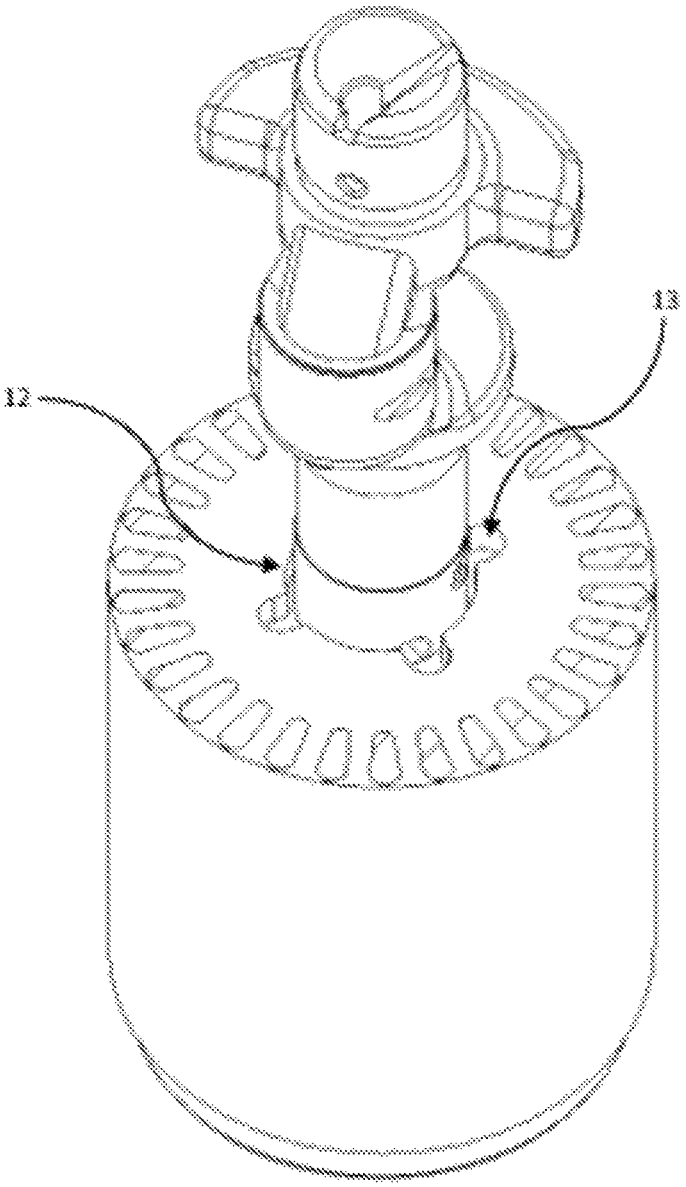
FIG. 5 is another perspective of the first embodiment of the shaft-rotor set, with the rotor in horizontal section, to show the circumferential channel and the radial channels and how they cooperate with the end of the external helical concavities of the shaft according to the present invention.
Figure 6:
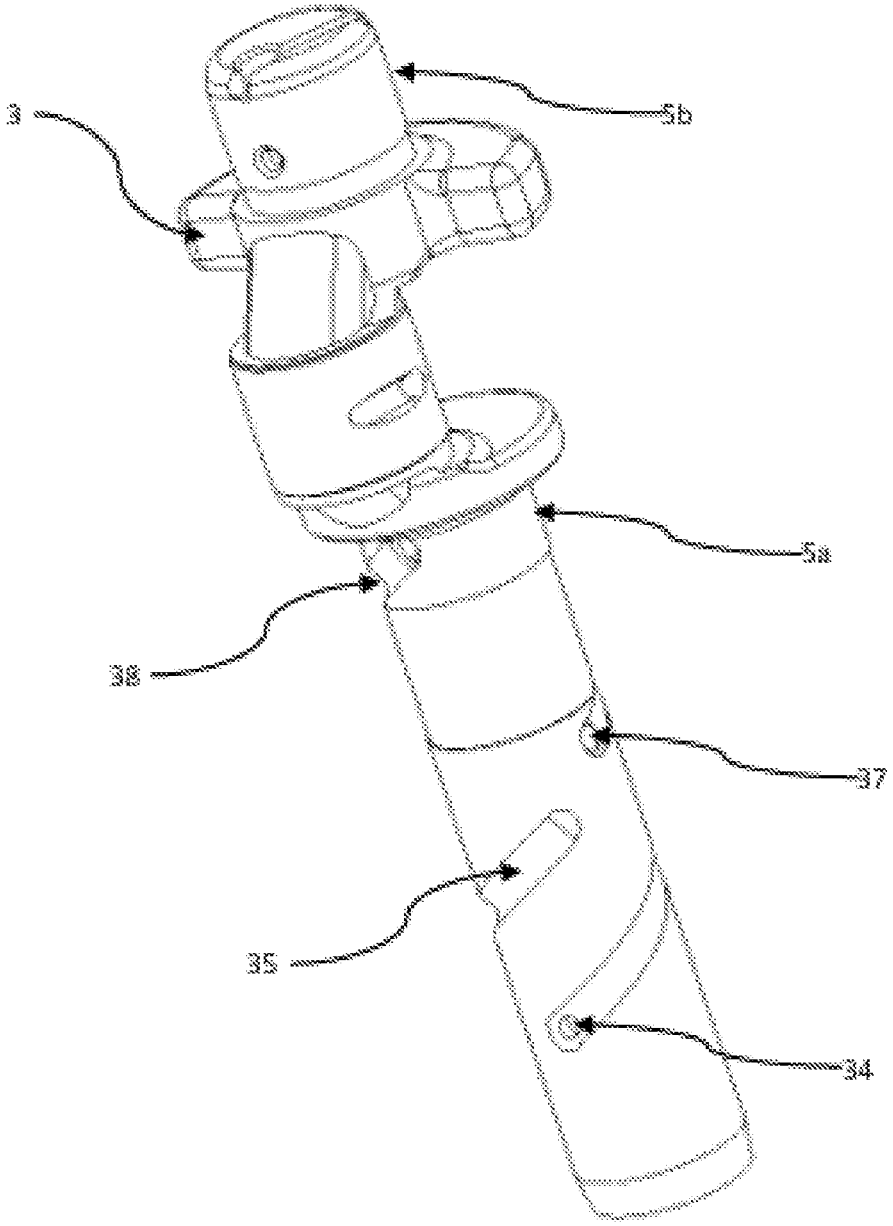
FIG. 6 illustrates a perspective view of the first embodiment of the rotating shaft showing the concavities on the rotating surface according to the present invention.
Figure 7:
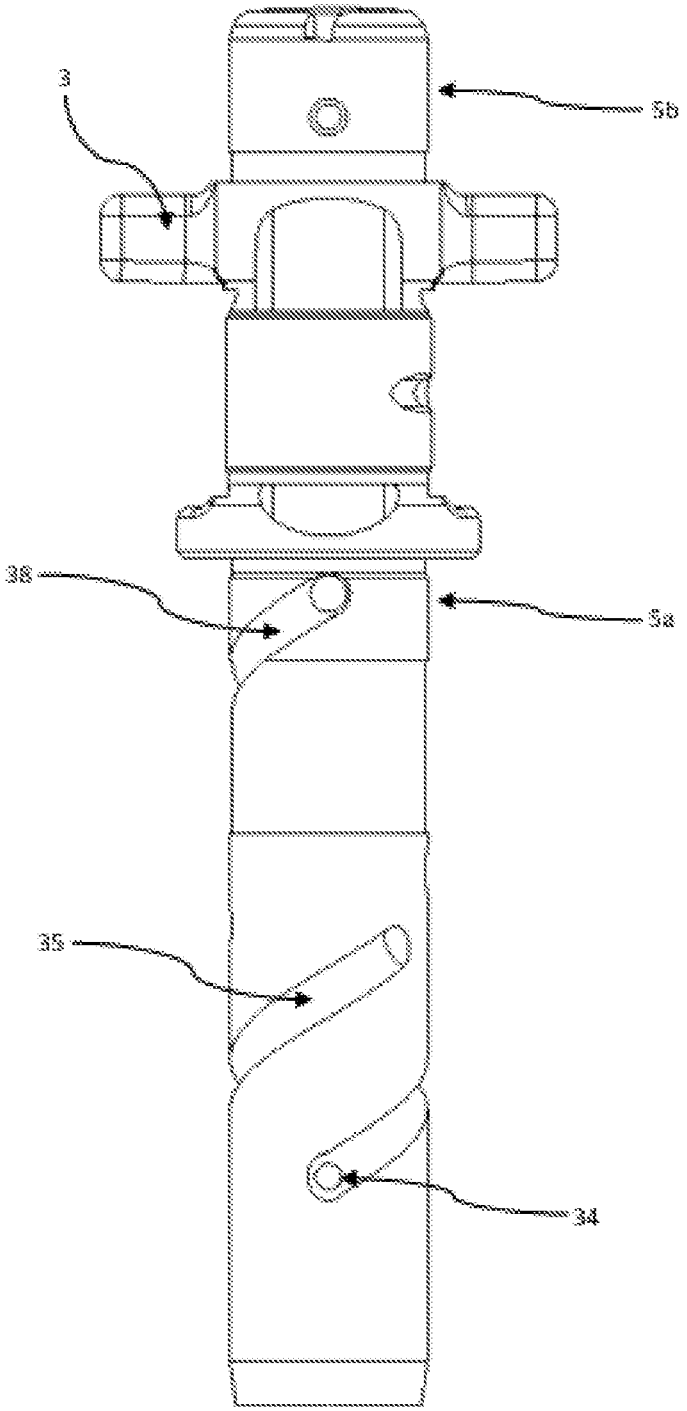
FIG. 7 illustrates an anterior view of the first embodiment of the rotating shaft, with the helical concavities for cooling the motor at the bottom and the helical concavity for lubricating the bearings at the top of the rotating region of the shaft. It is also possible to see the restrictor hole for cooling the motor at the beginning of the helical cavity at the lower region of the shaft according to the present invention.
Figure 8:
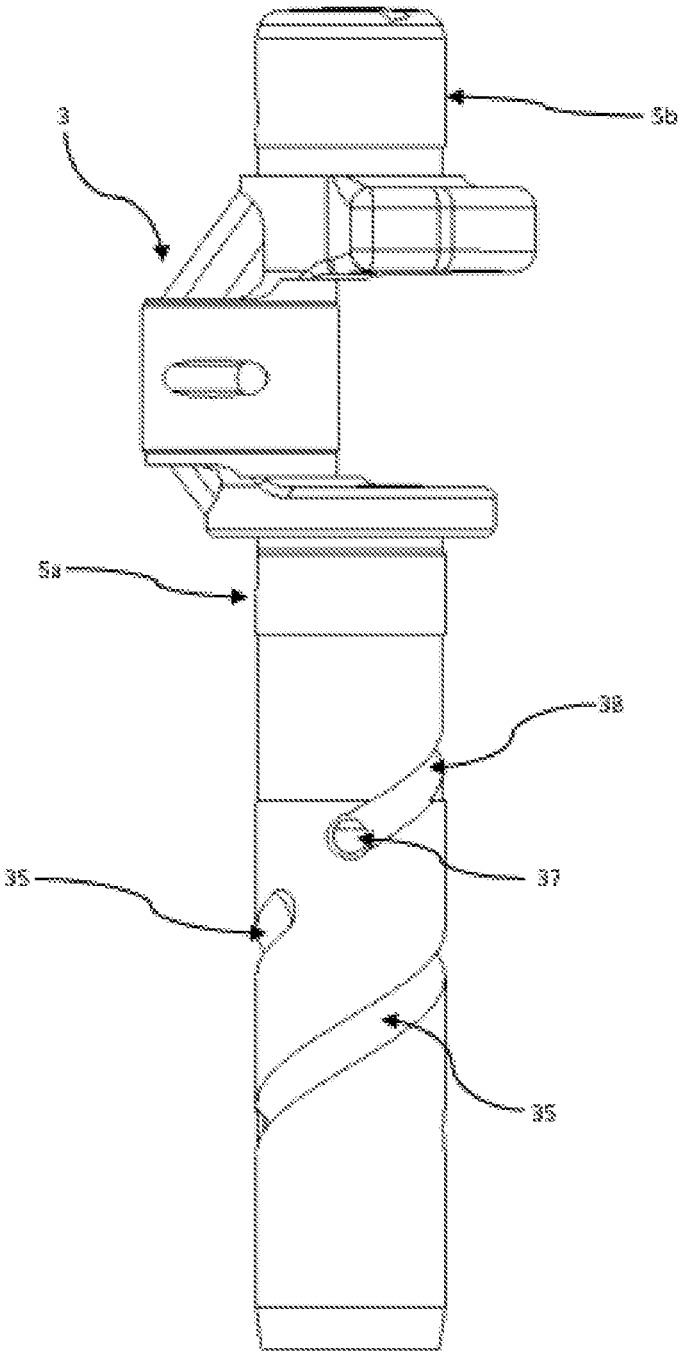
FIG. 8 illustrates a right-side view of the first embodiment of the rotating shaft, showing the oil feed hole of the helical concavity for lubricating the bearings in the top of the rotating region of the shaft according to the present invention.
Figure 9:
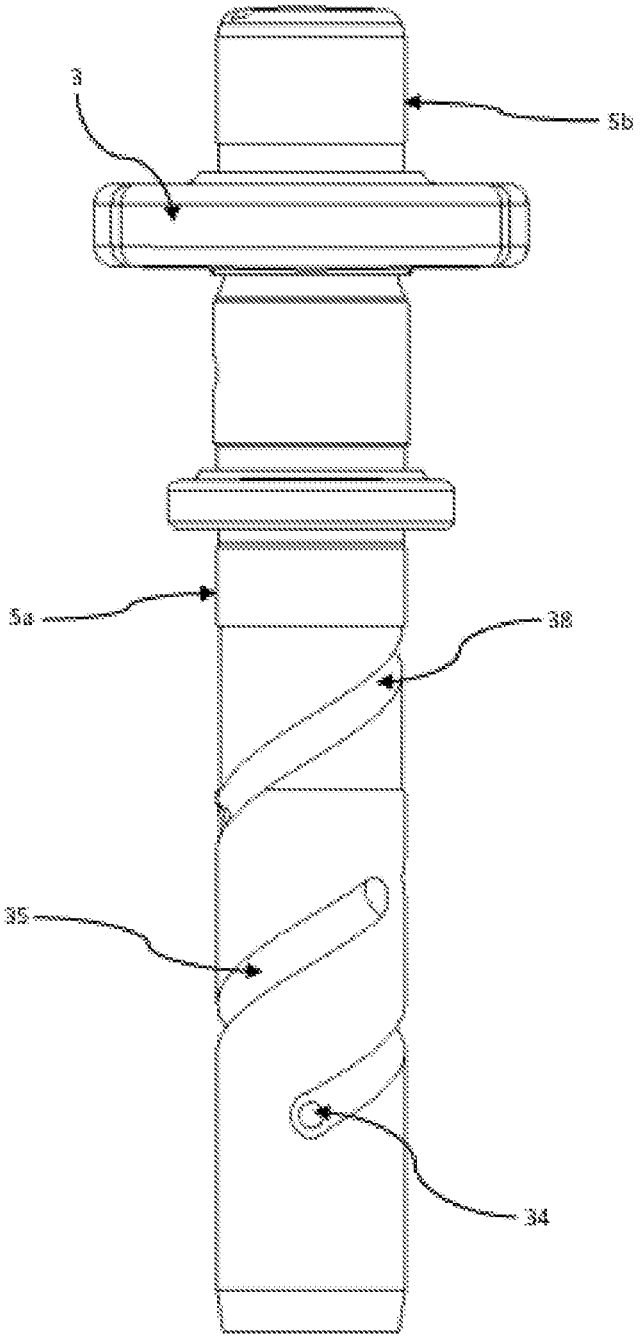
FIG. 9 illustrates a posterior view of the first embodiment of the rotating shaft, with the helical concavities for cooling the motor at the bottom and the helical concavity for lubricating the bearings at the top of the rotating region of the shaft. It is also possible to see a second restrictor hole for cooling the motor at the beginning of a second helical cavity at the lower region of the shaft according to the present invention.
Figure 10:
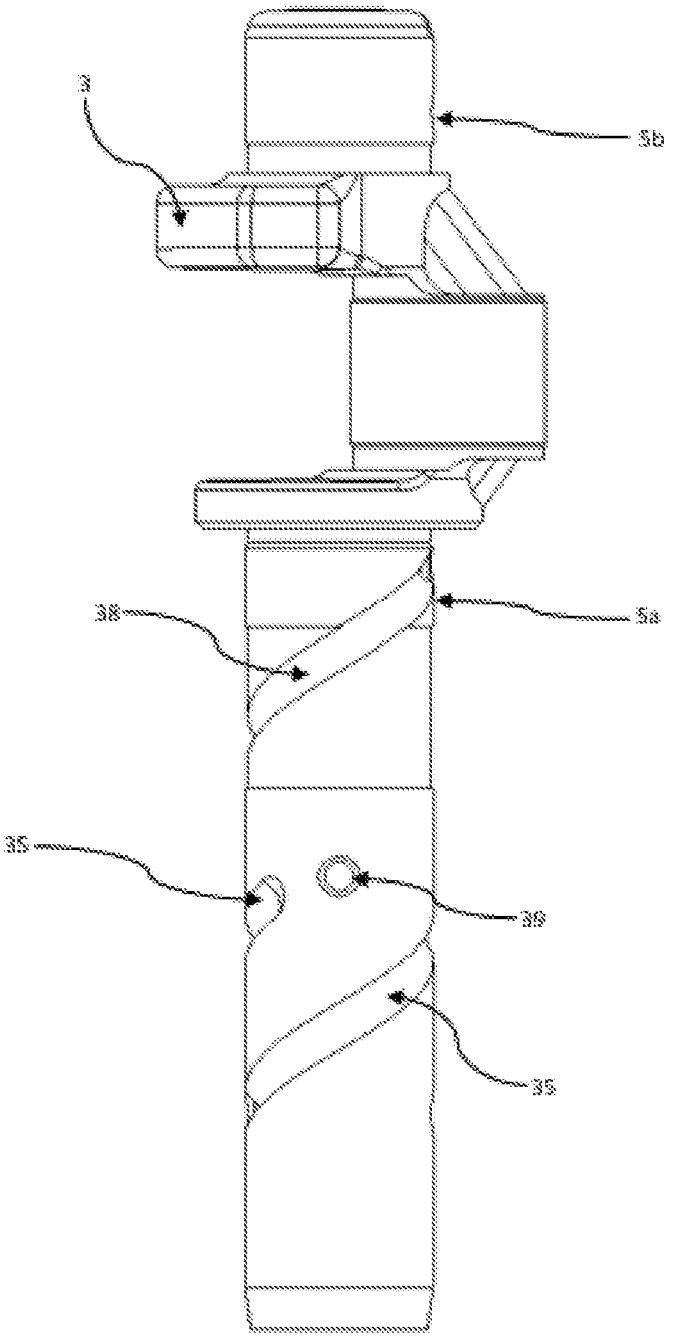
FIG. 10 illustrates a left side view of the first embodiment of the rotating shaft, showing the oil degassing hole for lubricating the bearings at the end of the shaft region with interface to the rotor according to the present invention.

According to FIGS. 4 and 5, the rotor 1 further comprises a circumferential channel 12 and at least one radial channel 13 extending through the inner wall 11 of the rotor 1. Said circumferential channel 12 cooperates with the radial channel 13, equally distributing the flow of lubricating oil provided by the concavity 35, regardless of the angular position of the rotor 1 in relation to the rotating shaft 3 and, consequently, in relation to the concavity 35. According to FIG. 11, the maximum diameter of the circumferential channel 12 must be smaller than the minimum outer diameter of the rotating shaft 3 housing in the compressor block 4, in order to limit the vertical displacement of the rotating shaft 3—rotor 1 set in relation to the compressor block 4. On the other hand, the length of the radial channel 13 must be dimensioned in such a way that its outlet is inscribed in a larger diameter than the same external diameter of the rotating shaft 3 housing in the compressor block 4, in order to ensure unrestricted flow of oil through the space 41 formed between the aluminum ring 14 of the rotor 1 and the compressor block 4, even under conditions where the vertical clearance between the rotor 1 and the rotating shaft 3 housing in the block compressor 4 is too small.

In a first preferred embodiment, the concavity 35 has a helicoid shape, extending in a spiral over part of the rotating surface 33. The recess must open towards the circumferential channel 12. This circumferential channel 12 also communicates with at least one radial channel 13.

Figure 11:
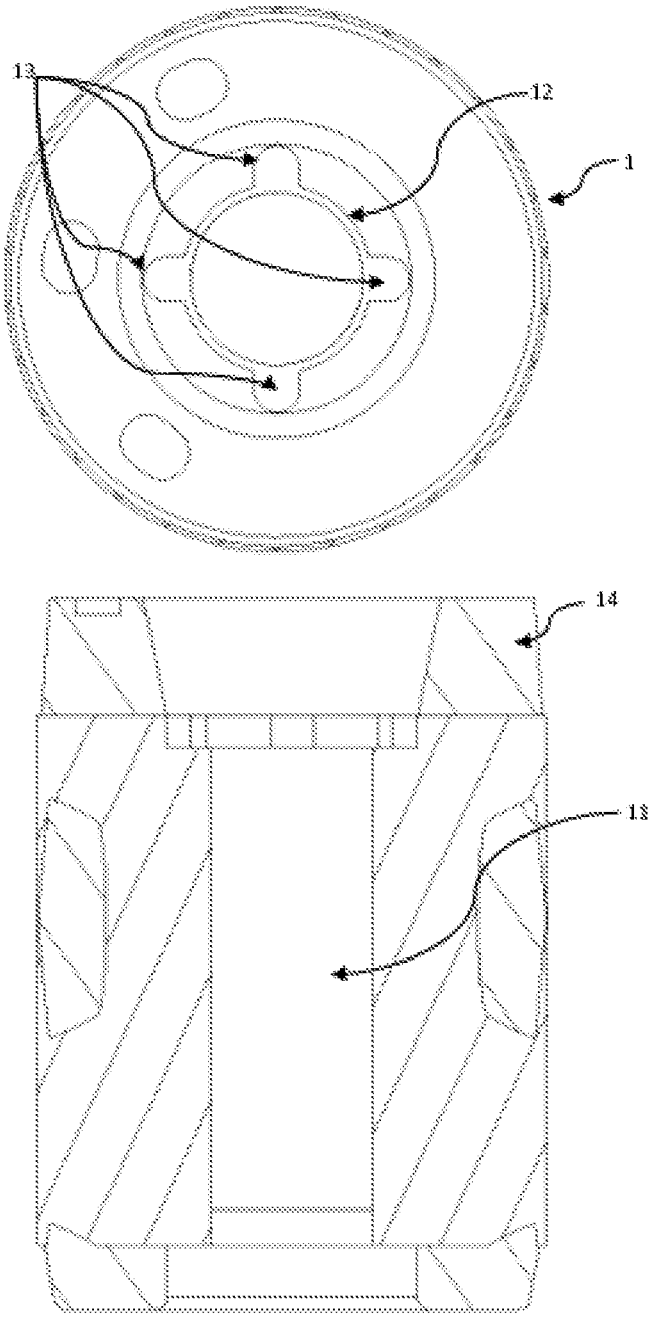
FIG. 11 illustrates a top view of the first embodiment of the rotor showing the radial channels and the circumferential channel at the top and a vertical sectional view of the rotor, showing the internal configuration of the radial and circumferential channels of the rotor according to present invention.

The number of concavities 35 and restrictor holes 34 depend on the cooling need of the stator 2, where the electric motor coils are housed. FIGS. 6 to 10 illustrate several views of the rotating shaft 3. Likewise, the number of radial channels 13 in the rotor must allow the free flow of oil into space 41 and in a way provide a symmetry of the rotor, in order to leave it balanced, as illustrated in FIG. 11.

Figure 12:
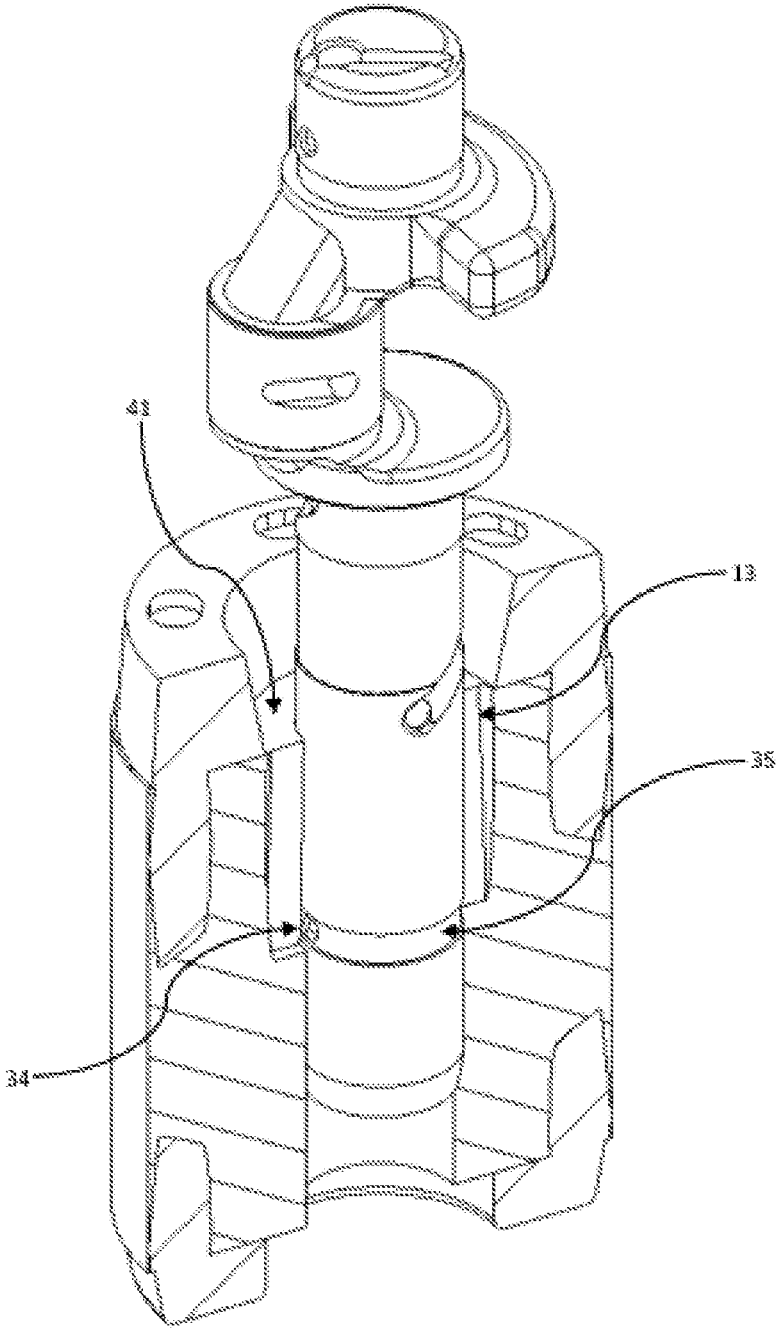
FIG. 12 illustrates a perspective view of the second embodiment of the shaft-rotor set, without the need for upward helical concavities on the rotating shaft for motor cooling, but with the restrictor hole and a circumferential communication concavity with the rotor according to the present invention.
Figure 13:
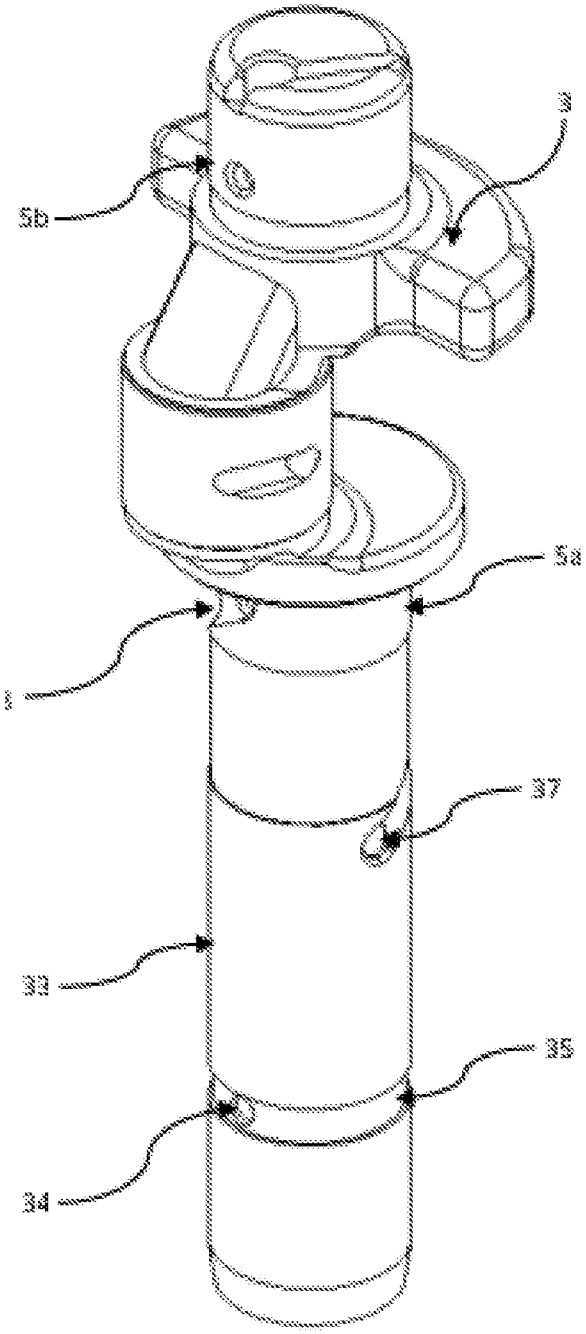
FIG. 13 illustrates a perspective view of the second embodiment of the rotating shaft with the configuration of the circumferential channel on the external surface of the rotating shaft according to the present invention.
Figure 14:
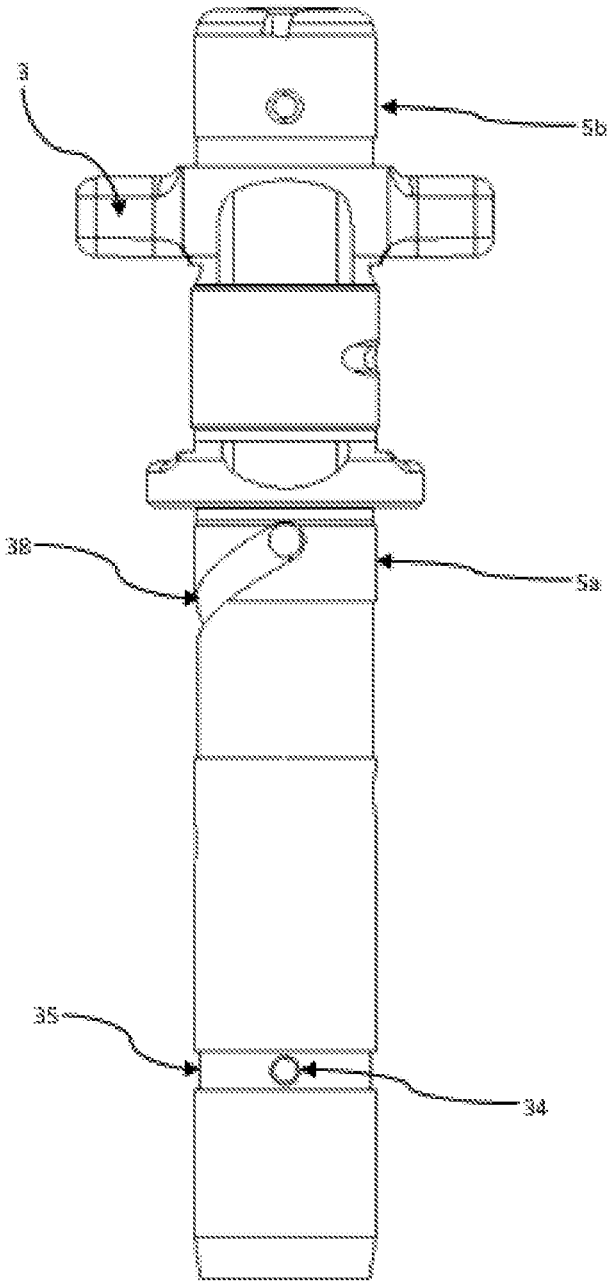
FIG. 14 illustrates an anterior view of the second embodiment of the rotating shaft, with the circumferential channel for cooling the motor at the bottom and the helical concavity for lubricating the bearings at the top of the rotating region of the shaft. It is also possible to see the restrictor hole for cooling the motor in the middle of the circumferential channel at the lower region of the shaft according to the present invention.
Figure 15:
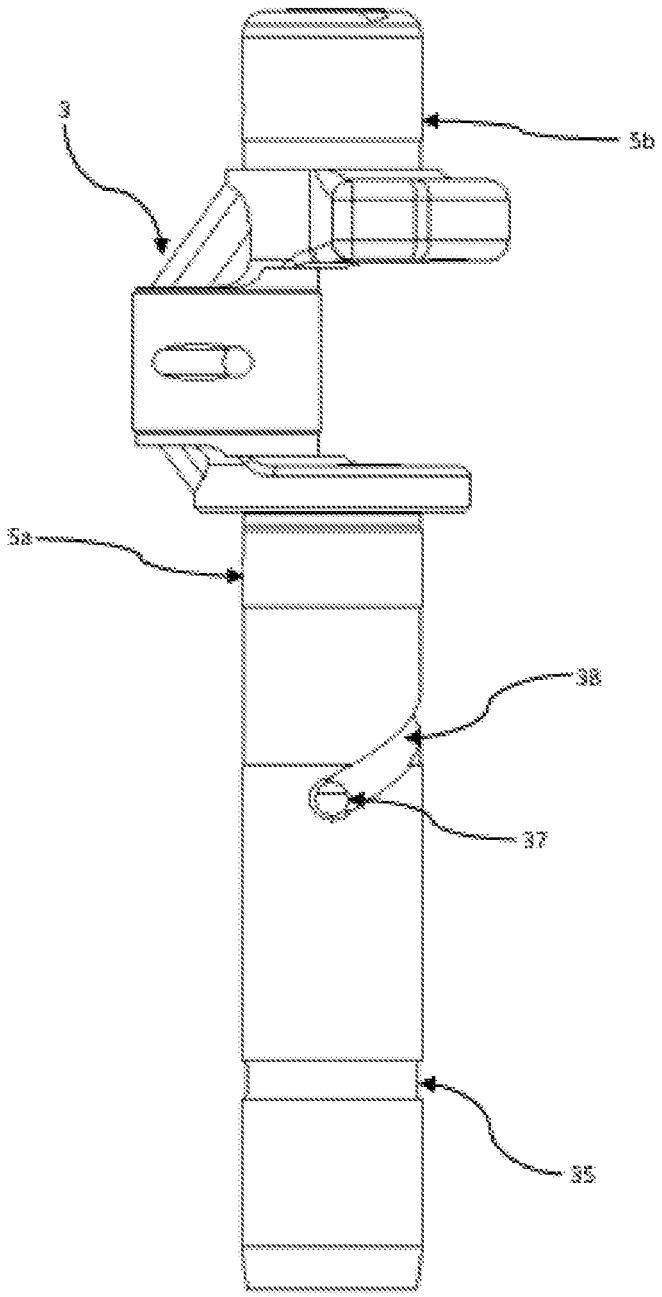
FIG. 15 illustrates a right-side view of the second embodiment of the rotating shaft, showing the oil supply hole of the helical concavity for lubricating the bearings in the top of the rotating region of the shaft according to the present invention.
Figure 16:
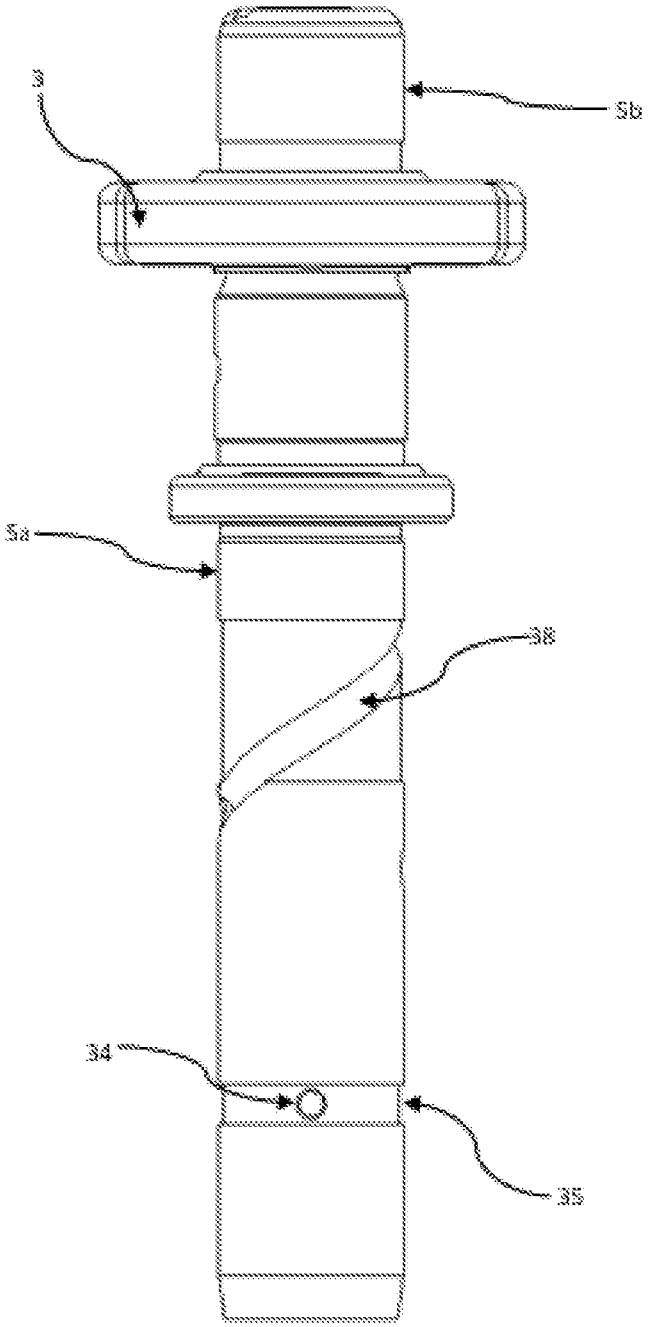
FIG. 16 illustrates a posterior view of the second embodiment of the rotating shaft, with the circumferential channel for cooling the motor at the bottom and the helical concavity for lubricating the bearings at the top of the rotating region of the axis. It is also possible to see a second restrictor hole for cooling the motor in the middle of the circumferential channel at the lower region of the shaft according to the present invention.
Figure 17:
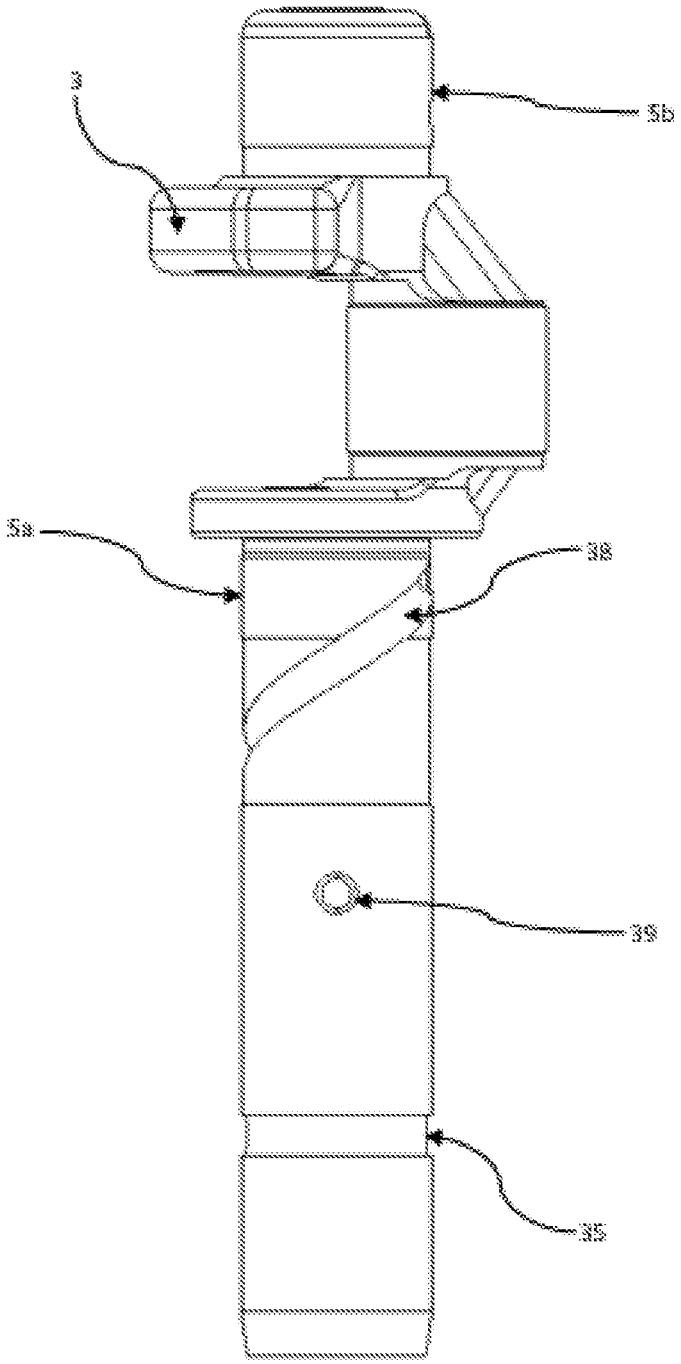
FIG. 17 illustrates a left side view of the second embodiment of the rotating shaft, showing the oil degassing hole for lubricating the bearings at the end of the shaft region with interface to the rotor according to the present invention.
Figure 18:
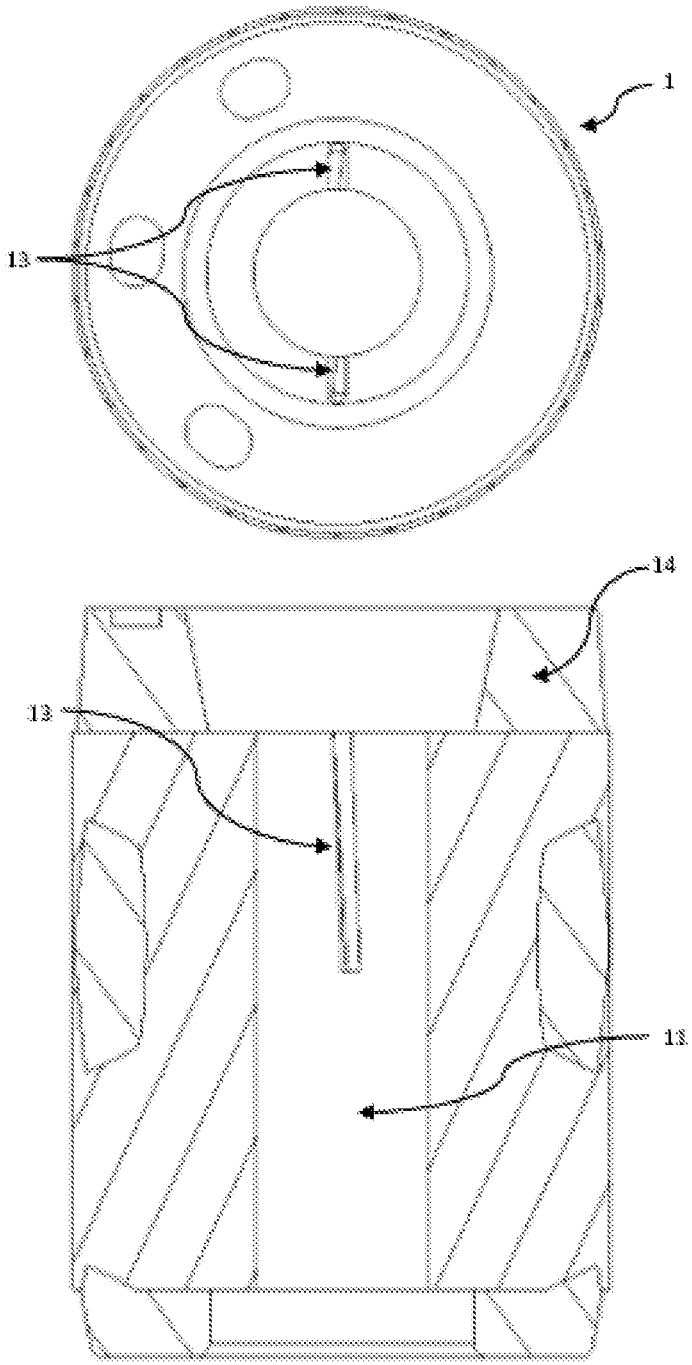
FIG. 18 illustrates a top view of the second embodiment of the rotor, with upward radial channels and a sectional view, showing the internal arrangement of these channels according to the present invention.
Figure 19:
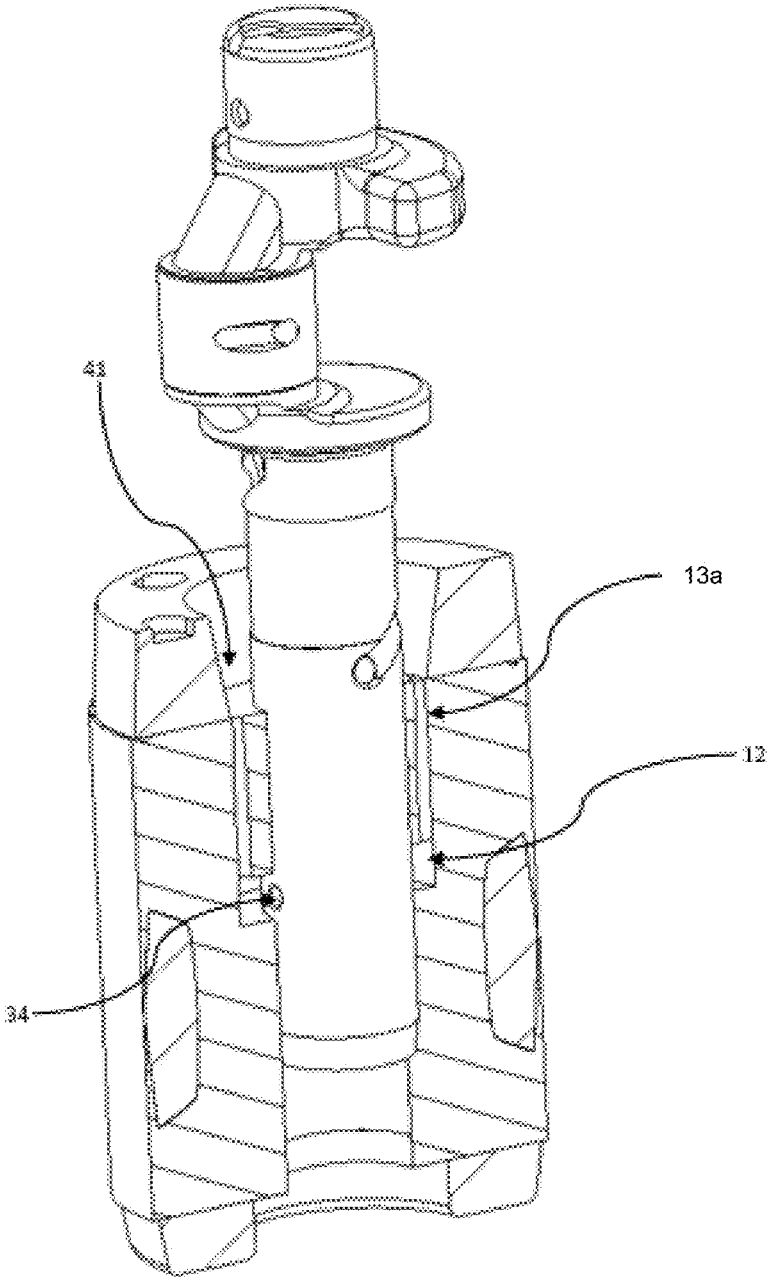
FIG. 19 illustrates a perspective view of the third embodiment of the shaft-rotor set, without cavities in the shaft for cooling the motor, only with the restrictor hole for oil passage according to the present invention.
Figure 20:
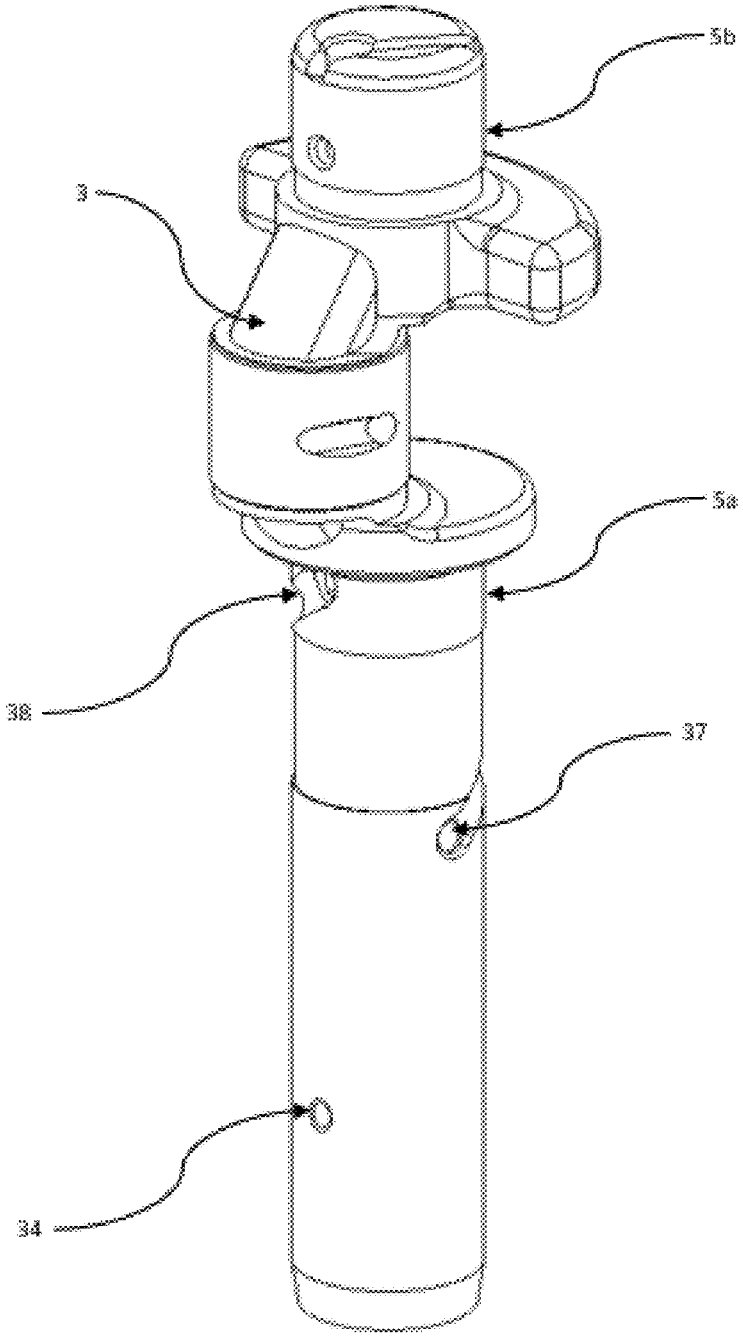
FIG. 20 illustrates a perspective view of the third embodiment of the rotating shaft, with only the restrictor hole for oil passage according to the present invention.
Figure 21:
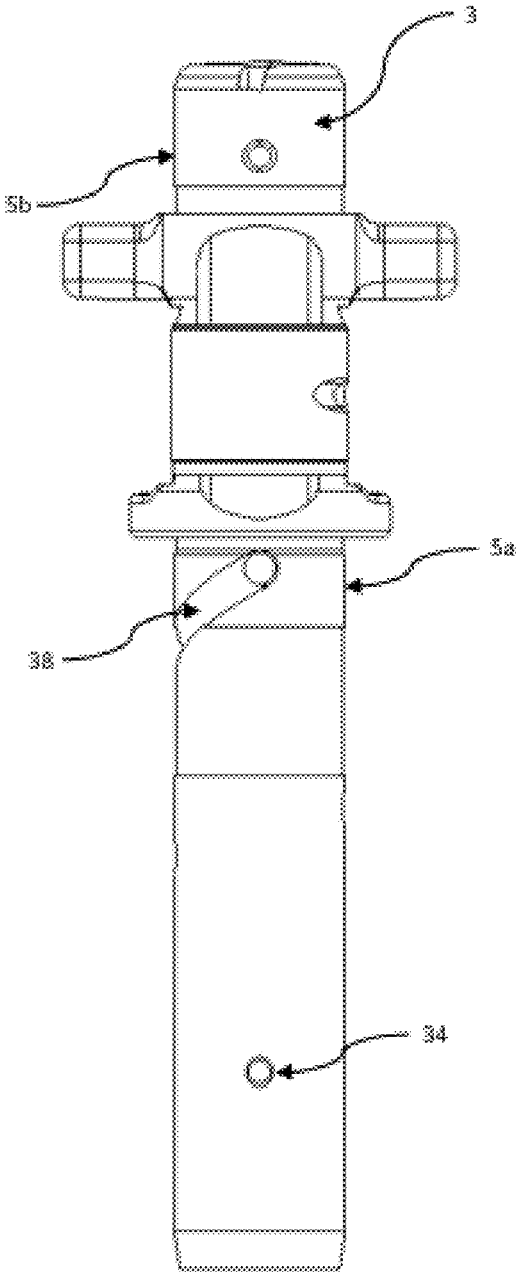
FIG. 21 illustrates an anterior view of the third embodiment of the rotating shaft with the restrictor hole at the bottom and the helical concavity for transporting oil to the bearings at the top of the rotating region of the axis according to the present invention.
Figure 22:
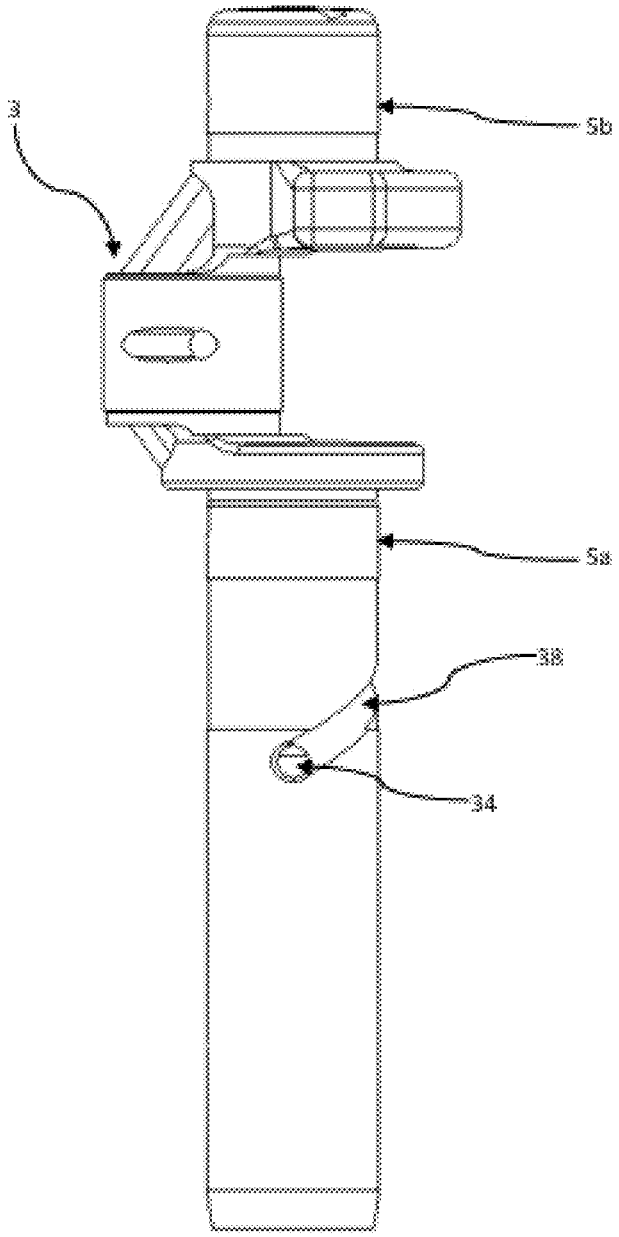
FIG. 22 illustrates a right-side view of the third embodiment of the rotating shaft, showing the it supply hole of the helical concavity for lubricating the bearings in the top of the rotating region of the shaft according to the present invention.
Figure 23:
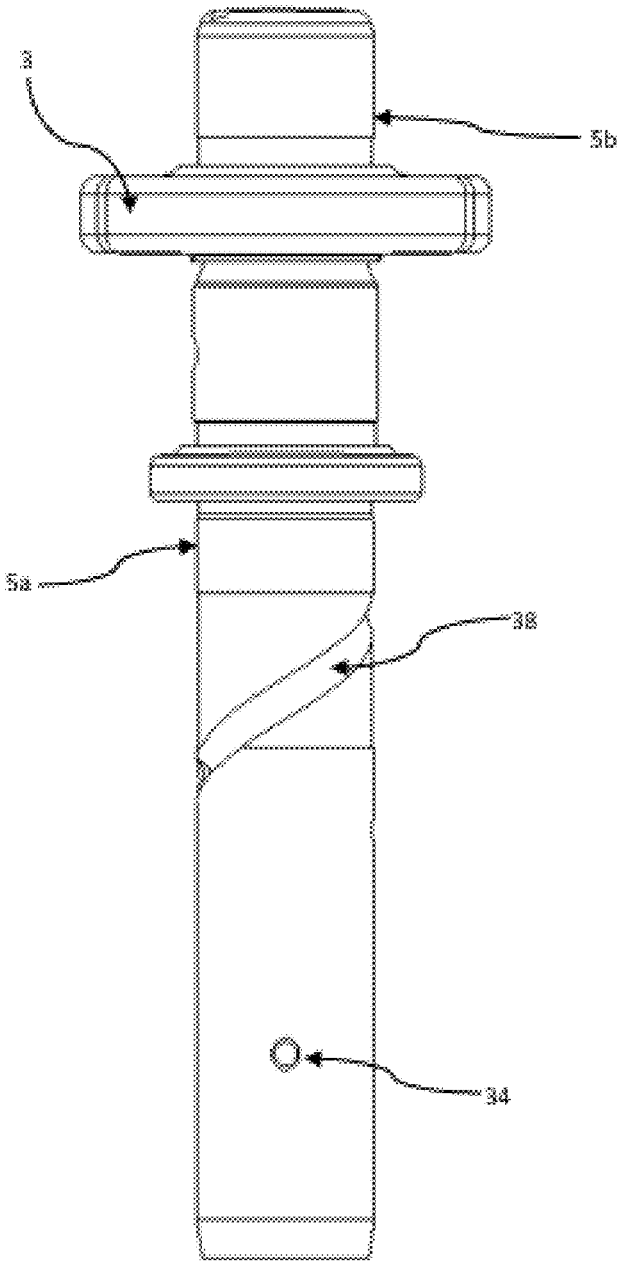
FIG. 23 illustrates a posterior view of the third embodiment of the rotating shaft, with a second restrictor hole for cooling the motor at the bottom and the helical concavity for lubricating the bearings at the top of the rotating region of the shaft according to the present invention.
Figure 24:
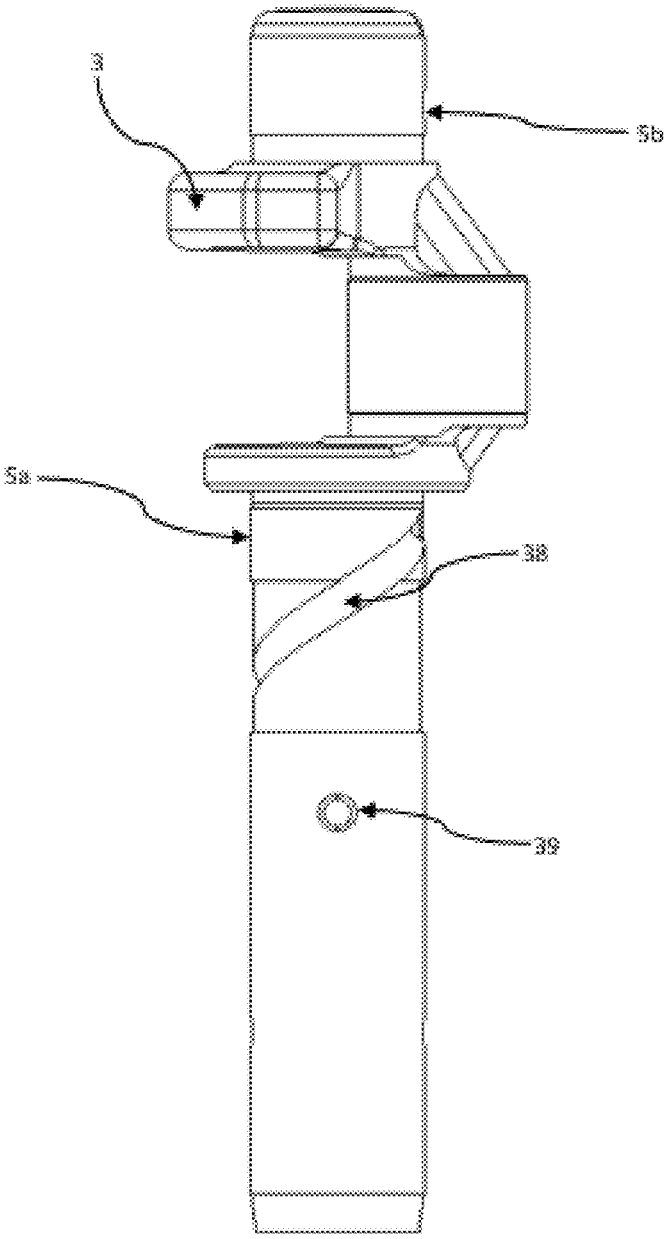
FIG. 24 illustrates a left side view of the third embodiment of the rotating shaft, showing the oil degassing hole for lubricating the bearings at the end of the shaft region with interface with the rotor according to the present invention.
Figure 25:
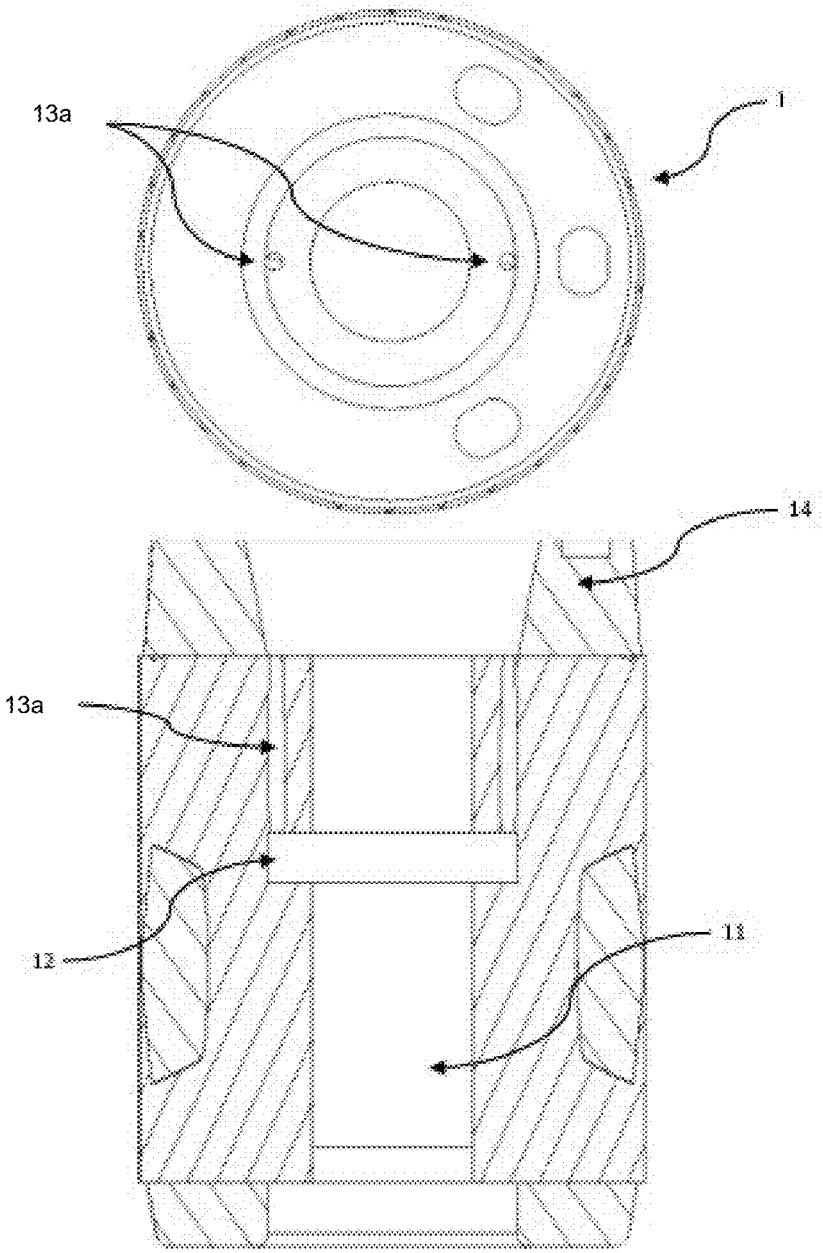
FIG. 25 illustrates a top view of the third embodiment of the rotor, with a circumferential channel located at an intermediate height in relation to the restrictor hole of the rotating shaft and upward radial channels responsible for allowing the passage of oil for cooling the motor to the top of the rotor. A cross-sectional view is also presented to facilitate understanding of the internal configuration of the rotor according to the present invention.

In a second possible embodiment, illustrated in FIGS. 12 to 17, the concavity 35 has an annular shape, extending around the rotating surface 33. In this configuration, at least one upward radial channel 13 is provided in the inner wall 11 of the rotor 1 which communicates with the concavity 35 of the rotating shaft 3. In this case, the rotor 1 may or may not have the circumferential channel 12 on its inner wall. FIG. 12 illustrates the rotor 1 provided with only the radial channel 13. The restrictor hole 34 is responsible for diverting part of the oil pumped by the pump 6 to the annular concavity 35, said concavity 35 makes the distribution of this oil flow until it finds the upward radial 13 channel, exiting into space 41 and finally being thrown against the coils of stator 1 on the top of the electric motor. In addition, FIG. 18 illustrates the configuration of the rotor 1 for carrying out this second embodiment.

Figure 26:
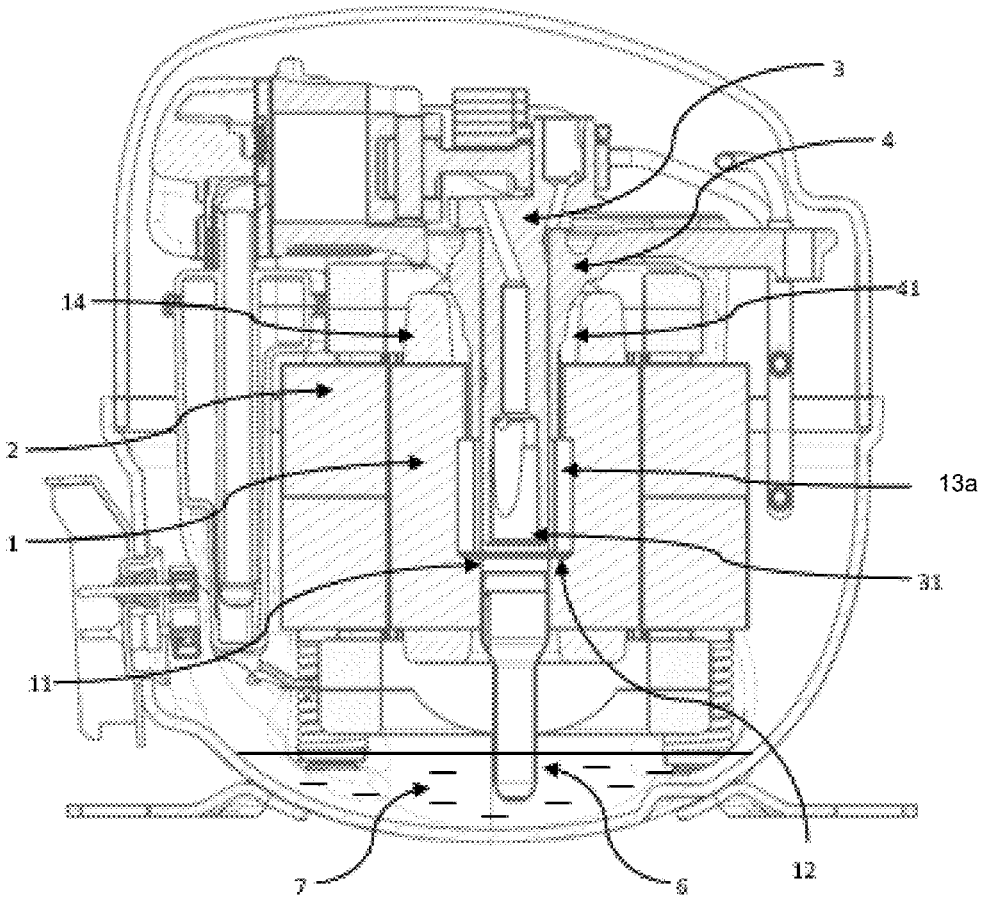
FIG. 26 illustrates a sectional view of a compressor according to a fourth embodiment of the motor cooling system by oil jet, when the oil pump is coupled to the rotor according to the present invention.

In a third alternative embodiment, illustrated in FIGS. 19 to 25, there is no concavity 35 on the rotating surface 33, only the restricted hole 34 remaining for communication with the internal part of the rotating shaft 3. In this embodiment, at least one radial channel 13 is provided on the inner wall 11 of the rotor 1, said radial channel 13 communicating with the circumferential channel 12 located at a height of the rotor 1 at the same level as the restrictor hole 34. Said circumferential channel 12, provided on the inner wall of the rotor 1, ensures that a specific angular positioning of rotor 1 with rotating shaft 3 is not necessary in order to align the restrictor hole 34 with the radial channel 13. FIG. 26 illustrates rotor 1 in this third embodiment.

In any constructive situation of the rotor 1, preferably two or more radial channels 13 are applied to the inner wall 11, said channels 13 disposed in order to guarantee the symmetry of the rotor 1 and avoid problems of unbalance. These radial channels 13 can and should follow the rotation angle of the aluminum bars of the rotor 1 cage and being obtained directly from the stamping of the rotor 1 blades.

The previous embodiments can be applied to compressors whose oil pump 6 is mounted by internal or external interference to the lower region 31 of the rotating shaft 3, or even by interference in relation to the internal wall 11 of the rotor 1, the deviation of oil for cooling the coil being carried out by the restrictor hole 34 provided on the rotating shaft 3.

Figure 27:
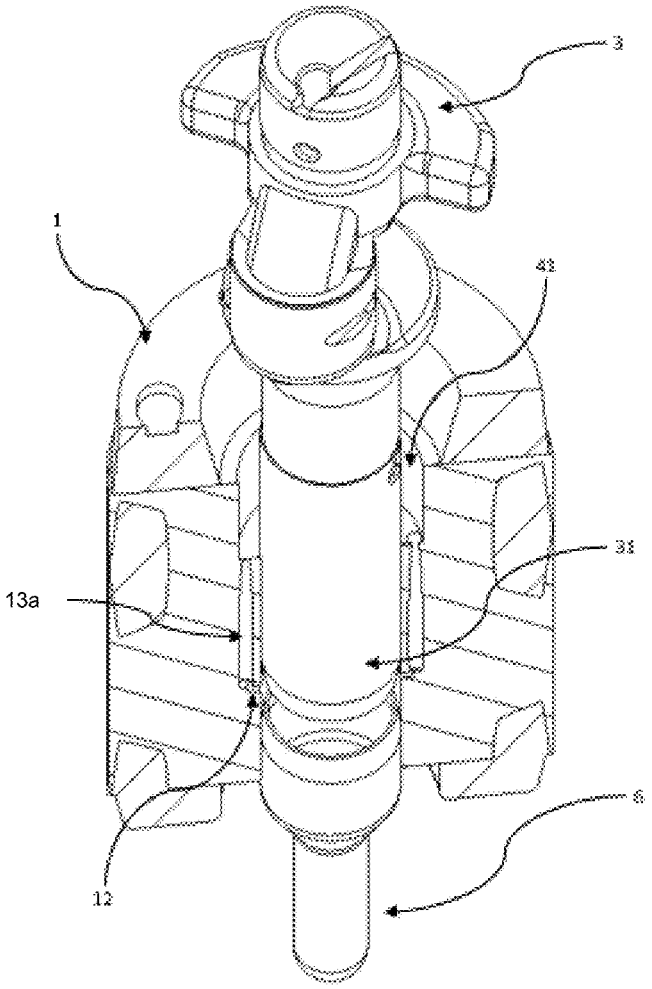
FIG. 27 illustrates a perspective view of the fourth embodiment of the shaft-rotor-oil pump set, with a partial cut applied to the rotor illustrating its internal configuration and the relative position of the circumferential channel and ascending radial channels in relation to the rotating shaft and the oil pump according to the present invention.
Figure 28:
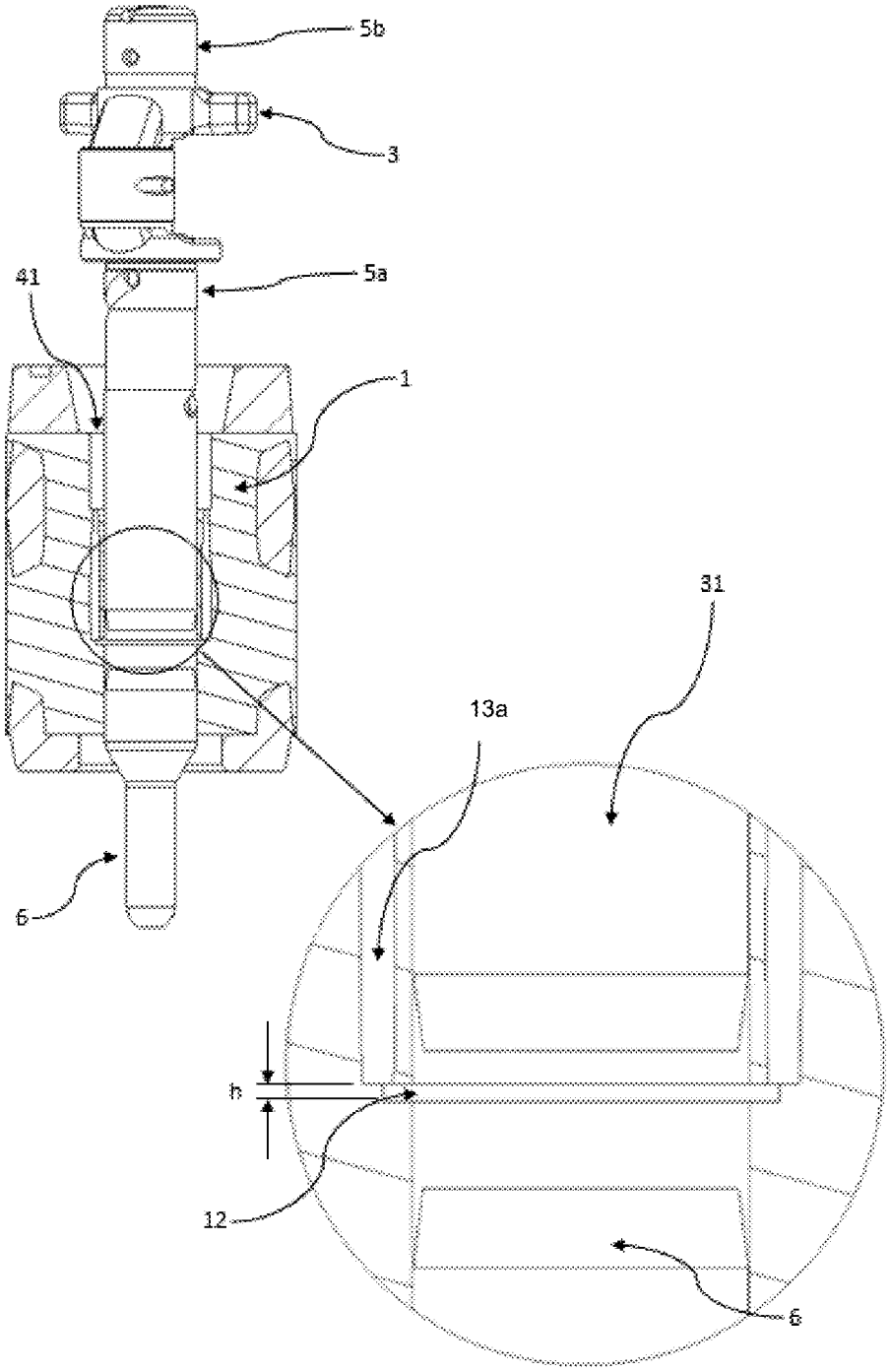
FIG. 28 illustrates an anterior view of the fourth embodiment of the shaft-rotor-oil pump set, with a partial cut applied to the rotor illustrating its internal configuration and the relative position of the circumferential channel and ascending radial channels in relation to the rotating shaft and the oil pump. A detail is provided indicating the height "h" of the circumferential channel, now also responsible for defining the flow of oil diverted for cooling the motor coils according to the present invention.

A fourth embodiment is illustrated in FIG. 26. This embodiment is only used in hermetic compressors in which the oil pump 6 is mounted by interference in relation to the internal wall 11 of the rotor 1. In this embodiment, the rotating shaft 3 does not need the restrictor hole 34, which can remain with the original oil pumping system. In this way, the oil diversion for cooling the motor coils takes place in a section of the inner wall 11 between the upper part of the oil pump 6 and the lower region 31 of the rotating shaft 3, through a circumferential channel 12. The channel circumferential has a height h, illustrated in FIG. 28. This circumferential channel 12 communicates with at least one upward radial channel 13, which takes this oil flow into space 41 and, subsequently, to the coils located at the top of stator 1 of the electric motor, as shown in FIG. 27.

Figure 29:
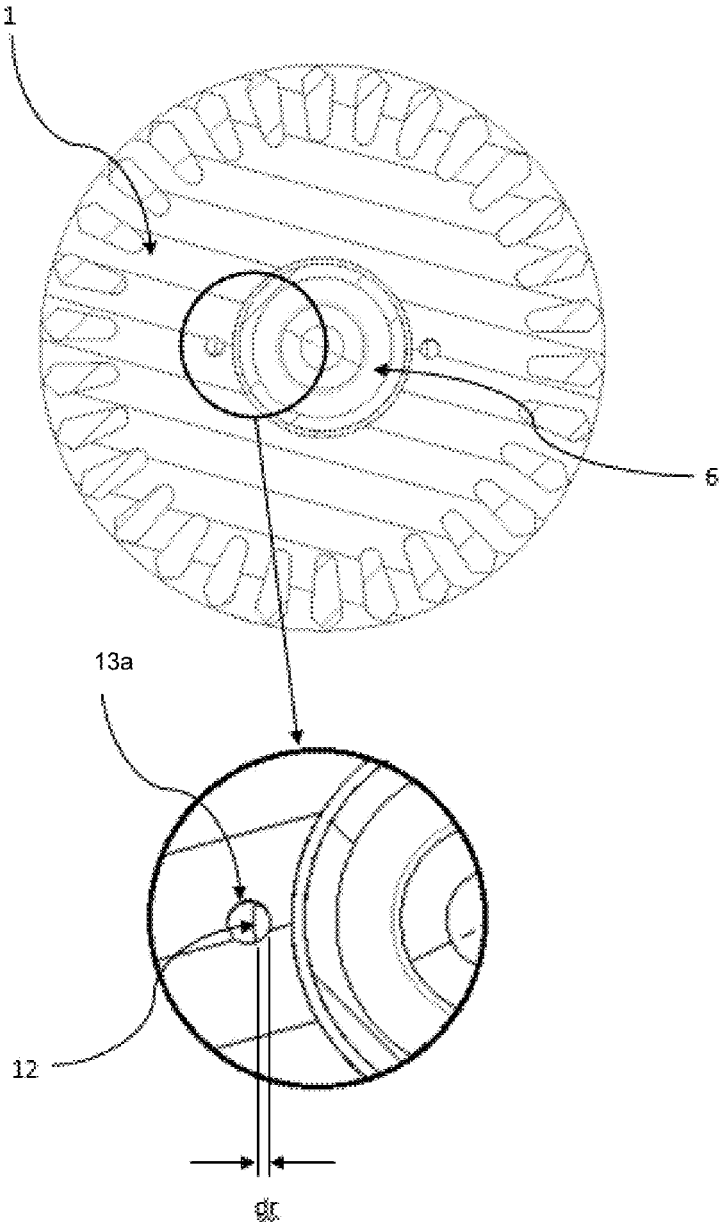
FIG. 29 illustrates a horizontal section of the fourth embodiment of the shaft-rotor-oil pump set located immediately above the circumferential channel in the rotor, illustrating in detail an alternative configuration for the transition between the circumferential channel and the ascending radial channels, which can be added to suit the oil flow for cooling the motor coils according to the present invention.

The circumferential channel 12 can be obtained directly by stacking sheets of electric steel. However, this will cause the height h to be an integer multiple of the thickness of the blade of the electric rotor steel. If this height h results in an oil flow deviated for the cooling of the electric motor coils that affects the flow required for the lubrication of the radial bearings 5*a* and 5*b*, for example, an additional restriction can be provided by the partial juxtaposition of the outside diameter of the circumferential channel 12 with the diameter of the upward radial channel 13, as represented by the dimension dr in the detail of FIG. 29.

It is important to note that the above descriptions have the sole purpose of describing in particular exemplary embodiments of the present invention. Therefore, it is clear that modifications, variations and constructive combinations of the elements that perform the same function in substantially the same way to achieve the same results, remain within the scope of protection defined by the attached claims.

The invention claimed is:

1. A system for transporting lubricating oil in a compressor, comprising:

a housing;

an electric motor comprising a rotor and a stator, the rotor comprising at least one inner wall;

an oil pump and an oil reservoir arranged inside the housing;

a rotating shaft as an integral part of the electric motor;

a compressor block configured to house, at least partially, the rotating shaft;

the rotating shaft supported by at least one radial bearing;

the rotating shaft comprising a lower region, an upper region and a rotating surface;

wherein the rotating shaft has at least one concavity that extends over part of the rotating surface in contact with the internal surface of the rotor and at least one restrictor hole which communicates with the internal region of the rotating shaft and with the concavity;

the rotor comprises a circumferential channel and at least one radial channel extending through the inner wall of the rotor;

the radial channel is arranged around the circumferential channel;

the circumferential channel and the radial channel communicating with the concavity;

the circumferential channel, the radial channel and the concavity configured to transport oil for cooling the upper part of the rotor and the stator.

2. The system for transporting lubricating oil in a compressor, according to claim 1, wherein the concavity has a helicoid shape.

3. The system for transporting lubricating oil in a compressor, according to claim 1, wherein the circumferential channel has an external diameter smaller than the external diameter of the rotating shaft housing in the compressor block.

4. The system for transporting lubricating oil in a compressor, according to claim 1, wherein the radial channel outlet is inscribed in a circle with a diameter larger than the outer diameter of the rotating shaft housing in the compressor block.

5. A system for transporting lubricating oil in a compressor, comprising:

a housing;

an electric motor comprising a rotor and a stator, the rotor comprising at least one inner wall;

an oil pump and an oil reservoir arranged inside the housing;

a rotating shaft as an integral part of the electric motor;

a compressor block configured to house, at least partially, the rotating shaft;

the rotating shaft supported by at least one radial bearing;

the rotating shaft comprising a lower region, an upper region and a rotating surface;

wherein the rotor comprises at least one radial channel arranged around a circumferential channel;

wherein the circumferential channel extends over at least part of the inner wall of the rotor;

wherein the circumferential channel is located at an intermediate level between the upper part of the oil pump and the lower region of the rotating shaft;

wherein the circumferential channel and the radial channel carry oil for cooling the upper part of the rotor and the stator; and wherein there is a partial juxtaposition between the entrance of the radial channel and the outer diameter of the circumferential channel.

* * * * *